US009228799B2

(12) United States Patent
Kuczynko

(10) Patent No.: US 9,228,799 B2
(45) Date of Patent: Jan. 5, 2016

(54) FIREARM HAVING A REMOVABLE HAND GUARD

(71) Applicant: Grzegorz Kuczynko, Unionville, CT (US)

(72) Inventor: Grzegorz Kuczynko, Unionville, CT (US)

(73) Assignee: COLT'S MANUFACTURING COMPANY LLC, West Hartford, CT (US)

( * ) Notice: Subject to any disclaimer, the term of this patent is extended or adjusted under 35 U.S.C. 154(b) by 0 days.

(21) Appl. No.: 14/585,157

(22) Filed: Dec. 29, 2014

(65) Prior Publication Data

US 2015/0184976 A1 Jul. 2, 2015

Related U.S. Application Data

(63) Continuation of application No. 13/908,529, filed on Jun. 3, 2013, now Pat. No. 8,919,025, which is a continuation of application No. 11/869,676, filed on Oct. 9, 2007, now Pat. No. 8,453,364.

(60) Provisional application No. 60/849,957, filed on Oct. 6, 2006.

(51) Int. Cl.

| | |
|---|---|
| ***F41C 23/16*** | (2006.01) |
| ***F41G 1/033*** | (2006.01) |
| ***F41A 5/18*** | (2006.01) |

(52) U.S. Cl.

CPC . *F41C 23/16* (2013.01); *F41A 5/18* (2013.01); *F41G 1/033* (2013.01); *Y10T 29/49826* (2015.01)

(58) Field of Classification Search

CPC ..... F41C 23/16

USPC ..... 42/71.01, 72, 73; 89/37.04

See application file for complete search history.

(56) References Cited

U.S. PATENT DOCUMENTS

| | | | |
|---|---|---|---|
| 2,457,835 | A | 1/1949 | Schiff |
| 2,462,119 | A | 2/1949 | Moore |

(Continued)

FOREIGN PATENT DOCUMENTS

| | | | |
|---|---|---|---|
| WO | 2007014770 | A1 | 2/2007 |
| WO | 2008103193 | A2 | 8/2008 |

(Continued)

OTHER PUBLICATIONS

Para Ordnance 2010 Catalog.

(Continued)

*Primary Examiner* — Reginald Tillman, Jr.

(74) *Attorney, Agent, or Firm* — Cantor Colburn LLP

(57) ABSTRACT

A semi-automatic or automatic rifle is provided. The rifle having: an upper hand guard and a lower hand guard each removably secured to an upper receiver of the rifle, wherein the upper hand guard has an integral upper rail that extends along an upper surface of the upper hand guard and the upper hand guard has a rear tab that is received within a mating slot of the upper receiver when the upper hand guard is secured to the upper receiver and wherein the upper rail of the upper hand guard is contiguous with a receiver rail when the upper hand guard is secured to the upper receiver; a cap configured to releasably engage a forward end of the upper hand guard and a forward end of the lower hand guard; and wherein the upper hand guard and the lower hand guard are not directly secured to a barrel of the rifle such that the upper hand guard and the lower hand guard float in position relative to the barrel of the rifle.

17 Claims, 18 Drawing Sheets

(56) References Cited

U.S. PATENT DOCUMENTS

| | | | | |
|---|---|---|---|---|
| 2,777,366 | A | 1/1957 | Cook | |
| 3,075,314 | A | 1/1963 | Bakker | |
| 3,090,150 | A | 5/1963 | Stoner | |
| 3,592,101 | A | 7/1971 | Vartanian et al. | |
| 3,618,457 | A | 11/1971 | Miller | |
| 3,709,092 | A | 1/1973 | Tazome | |
| 3,810,412 | A | 5/1974 | Zamacola | |
| 3,945,296 | A | 3/1976 | Hyytinen | |
| 4,174,654 | A | 11/1979 | Liedke | |
| 4,244,273 | A | 1/1981 | Langendorfer, Jr. et al. | |
| 4,433,610 | A | 2/1984 | Tatro | |
| 4,433,611 | A | 2/1984 | Baumann | |
| 4,536,982 | A | 8/1985 | Bredbury et al. | |
| 4,658,702 | A | 4/1987 | Tatro | |
| 4,663,875 | A | 5/1987 | Tatro | |
| 5,010,676 | A | 4/1991 | Kennedy | |
| 5,272,956 | A | 12/1993 | Hudson | |
| 5,343,650 | A * | 9/1994 | Swan | 42/117 |
| 5,351,598 | A | 10/1994 | Schuetz | |
| 5,590,484 | A * | 1/1997 | Mooney et al. | 42/111 |
| 5,726,377 | A | 3/1998 | Harris et al. | |
| 5,760,328 | A | 6/1998 | Robbins | |
| 5,802,755 | A | 9/1998 | Tortorici et al. | |
| 5,824,943 | A | 10/1998 | Guhring et al. | |
| 5,900,577 | A | 5/1999 | Robinson et al. | |
| 5,937,563 | A | 8/1999 | Schuetz et al. | |
| 5,945,626 | A | 8/1999 | Robbins | |
| 6,205,696 | B1 | 3/2001 | Bilgeri | |
| 6,250,194 | B1 | 6/2001 | Brandl et al. | |
| 6,269,577 | B1 | 8/2001 | Hardy | |
| 6,295,751 | B1 | 10/2001 | Piwonski | |
| 6,308,609 | B1 | 10/2001 | Davies | |
| 6,314,672 | B2 | 11/2001 | Murello et al. | |
| 6,499,245 | B1 | 12/2002 | Swan | |
| 6,609,321 | B2 | 8/2003 | Faifer | |
| 6,671,990 | B1 | 1/2004 | Booth | |
| 6,848,351 | B1 | 2/2005 | Davies | |
| 6,959,509 | B2 | 11/2005 | Vais | |
| 7,059,076 | B2 | 6/2006 | Stoner et al. | |
| 7,131,228 | B2 | 11/2006 | Hochstrate et al. | |
| 7,137,217 | B2 | 11/2006 | Olson et al. | |
| RE39,465 | E | 1/2007 | Swan | |
| 7,213,498 | B1 | 5/2007 | Davies | |
| 7,313,883 | B2 | 1/2008 | Leitner-Wise | |
| RE40,216 | E | 4/2008 | Swan | |
| 7,363,741 | B2 | 4/2008 | DeSomma et al. | |
| 7,418,898 | B1 | 9/2008 | DeSomma | |
| 7,461,581 | B2 | 12/2008 | Leitner-Wise | |
| 7,469,624 | B1 | 12/2008 | Adams | |
| 7,523,580 | B1 | 4/2009 | Tankersley | |
| 7,574,823 | B2 | 8/2009 | Nakayama | |
| 7,584,567 | B1 | 9/2009 | DeSomma et al. | |
| 7,596,900 | B2 | 10/2009 | Robinson et al. | |
| 7,610,844 | B2 * | 11/2009 | Kuczynko et al. | 89/193 |
| 7,637,199 | B2 | 12/2009 | Fluhr et al. | |
| 7,640,689 | B2 | 1/2010 | Fluhr | |
| 7,707,762 | B1 | 5/2010 | Swan | |
| 7,716,865 | B2 | 5/2010 | Daniel et al. | |
| 7,739,939 | B2 | 6/2010 | Adams | |
| 7,779,743 | B2 | 8/2010 | Herring | |
| 7,810,271 | B2 | 10/2010 | Patel | |
| 8,117,958 | B2 | 2/2012 | Hochstrate et al. | |
| 2005/0000142 | A1 | 1/2005 | Kim et al. | |
| 2005/0115398 | A1 | 6/2005 | Olson | |
| 2005/0241470 | A1 | 11/2005 | Hochstrate et al. | |
| 2005/0262752 | A1 | 12/2005 | Robinson et al. | |
| 2005/0268513 | A1 | 12/2005 | Battaglia | |
| 2006/0026883 | A1 | 2/2006 | Hochstrate et al. | |
| 2006/0065112 | A1 | 3/2006 | Kuczynko et al. | |
| 2006/0236582 | A1 | 10/2006 | Lewis et al. | |
| 2006/0254414 | A1 | 11/2006 | Kuczynko et al. | |
| 2006/0260169 | A1 | 11/2006 | Samson et al. | |
| 2007/0033851 | A1 | 2/2007 | Hochstrate et al. | |
| 2007/0199435 | A1 | 8/2007 | Hochstrate et al. | |
| 2009/0000173 | A1 | 1/2009 | Robinson et al. | |
| 2009/0007477 | A1 | 1/2009 | Robinson et al. | |
| 2009/0031605 | A1 | 2/2009 | Robinson | |
| 2009/0031606 | A1 | 2/2009 | Robinson et al. | |
| 2009/0031607 | A1 | 2/2009 | Robinson et al. | |
| 2009/0038198 | A1 | 2/2009 | Yu et al. | |
| 2009/0056191 | A1 | 3/2009 | Battaglia | |
| 2010/0000400 | A1 | 1/2010 | Brown | |
| 2010/0101405 | A1 | 4/2010 | Adams | |
| 2010/0126054 | A1 | 5/2010 | Daniel et al. | |
| 2010/0175293 | A1 | 7/2010 | Hines et al. | |
| 2010/0186278 | A1 | 7/2010 | Daniel et al. | |
| 2010/0186582 | A1 | 7/2010 | Juarez et al. | |
| 2010/0199836 | A1 | 8/2010 | Herring et al. | |
| 2010/0218671 | A1 | 9/2010 | Mayberry et al. | |
| 2010/0269682 | A1 | 10/2010 | Vuksanovich et al. | |

FOREIGN PATENT DOCUMENTS

| | | | |
|---|---|---|---|
| WO | 2008140833 | A2 | 11/2008 |
| WO | 2009082520 | A2 | 7/2009 |
| WO | 2010111026 | A1 | 9/2010 |
| WO | 2010111109 | | 9/2010 |

OTHER PUBLICATIONS

"Small Arms of the World", 12th Revised Edition, Copyright 1983, Barnes & Noble 8 pages.

"Black Rifle II, The M16 Into the 21st Century", Collector Grade Publications Incorporated, 2004, ISBN 0-88935-348-4.

"Modern US Military Arms Series—Volume Three, The Black Rifle M16 Retrospective", Collectors Grade Publication Incorporated, 2004, ISBN 0-88935-115-5.

A Closer Look at the MGI QCB-D Upper Receiver, http://referenceonly.wordpress.com/2010/10/09/a-closer-look-at the-mgi-qcb-d-upper-receiver/.

Bushmaster Owner's Manual, http://www.bushmaster.com/electronic-documents/ACR-owners-manual.pdf.

http://barrett.net/pdfs/Manual-REC7.pdf.

M&P 15 Rifle Manual, http://smith-wesson.com/wcstore/smwesson2/upload/other/S&W_M&P15_Rifle_Manual.pdf.

Monolithic Tactical System, http://megamachineshop.com/pdf/MTS-Assembly-Instructions./pdf.

Para USA Tactical Rifle, http://www.americanrifleman.org/ArticlePage.aspx?id2070&cid=4.

RGP Brochure, http://remingtonmilitaiy.com/Firearms/Carbines/RGP.aspx.

Safety and Instruction Manual, http://www.ar15.com/content/manuals/Ir300.pdf.

Tactical Target Rifle Specifications, http://.paraord.com/new.product_rifle.php#specs.

* cited by examiner

FIREARM HAVING A REMOVABLE HAND GUARD

CROSS REFERENCE TO RELATED APPLICATIONS

This application is a continuation of U.S. patent application Ser. No. 13/908,529 filed Jun. 3, 2013, which is continuation of U.S. patent application Ser. No. 11/869,676 filed Oct. 9, 2007, now U.S. Pat. No. 8,453,364, which claims the benefit of U.S. Application No. 60/849,957, filed Oct. 6, 2006, the entire contents each of which are incorporated herein by reference thereto.

FIELD

The disclosed embodiments relate to firearms and, more particularly, to a firearm having a removable hand guard.

BACKGROUND

There is a demand from operators that firearms, such as automatic and semi-automatic rifles, have increased versatility allowing use of the firearm in different conditions. For example, operation desire to mount and switch between different accessory or peripheral devices to automatic and semi-automatic rifles that aid operator use of the firearm on different conditions. In addition to heightened versatility, operators desire robust construction and ease of operability and maintenance allowing the firearm to be versatile while being easy to use and having minimum maintenance needs even when undergoing harsh use in harsh conditions such as high humidity or high dust. Conventional firearms have not successfully satisfied the demands and desires of operators. U.S. Pat. No. 5,824,943 dated Oct. 20, 1998, discloses an example of a conventional self loading rifle with a gas pressure loading arrangement. The conventional gas pressure loading arrangement disclosed includes a gas cylinder fluidly connected to the bore of the rifle barrel, and a gas piston received in the gas cylinder to define a gas chamber. The gas chamber is readily susceptible to fowling resulting in stoppage of the firearm. The exemplary embodiments of the firearms disclosed herein overcome the problems of conventional firearms as will be further described below.

SUMMARY OF THE INVENTION

In accordance with one exemplary embodiment, a semi-automatic or automatic rifle is provided. The rifle has a receiver having a receiver frame, a barrel removably connected to the receiver frame and a cover coupled to the barrel. A removable hand guard section extends over and generally surrounds the barrel, the hand guard has at least two removable hand guard section pieces removably and independently connected to the receiver. The removable hand guard pieces has a locating feature adapted to engage with the cover and locate the at least two pieces relative to the cover. The locking collar mounted to the barrel and is adapted to removably position and lock the at least two pieces relative to the receiver frame and the barrel. The at least two pieces float in position relative to the barrel.

In accordance with another exemplary embodiment, a semi-automatic or automatic rifle is provided. The rifle has a receiver having a receiver frame, a barrel removably connected to the receiver frame and a cover coupled to the barrel. A two piece removable hand guard section extends over and generally surrounds the barrel, the two piece removable hand guard section removably connected to the receiver. The two piece removable hand guard section has locating features adapted to engage with the cover and locate the two piece hand guard relative to the cover. The barrel has a locking collar adapted to removably position and lock the two piece removable hand guard section relative to the receiver frame and the barrel. The two piece removable hand guard floats in position relative to the barrel.

In accordance with another exemplary embodiment, a semi-automatic or automatic rifle is provided. The rifle has a receiver having a receiver frame and a barrel connected to the receiver frame. An indirect gas operating system has a gas block and a movable piston, the gas block coupled to the barrel, the gas block in fluid communication with the barrel, the movable piston in communication with the gas block. A cover is coupled to the barrel with a removable hand guard section extending over and generally surrounds the barrel, the removable hand guard section removably connected to the receiver. The removable hand guard section has a locating feature adapted to engage with the cover and locate the hand guard relative to the cover. A locking feature is adapted to removably position and lock the removable hand guard section relative to the receiver frame and the barrel. The removable hand guard floats in position relative to the barrel.

In accordance with another exemplary embodiment, a semi-automatic or automatic rifle is provided. The rifle has a receiver having a receiver frame and a barrel connected to the receiver frame. An indirect gas operating system has a gas block and a movable piston, the gas block coupled to the barrel, the gas block in fluid communication with the barrel, the piston in communication with a cylinder within the gas block. The cylinder and the piston are removable from a front of the firearm without disassembly of the firearm. A cover is coupled to the barrel. A removable hand guard section extends over and generally surrounds the barrel, the removable hand guard section removably connected to the receiver. The removable hand guard section has a locating feature adapted to engage with the cover and locate the hand guard relative to the cover. A locking feature is adapted to removably position and lock the removable hand guard section relative to the receiver frame and the barrel. The removable hand guard floats in position relative to the barrel.

In accordance with another exemplary embodiment, a semi-automatic or automatic rifle is provided. The rifle has a receiver having a receiver frame and a barrel connected to the receiver frame. An indirect gas operating system has a gas block and a movable piston, the gas block coupled to the barrel, the gas block in fluid communication with the barrel, the piston in communication with a cylinder within the gas block. The cylinder and the piston removable from a front of the firearm without disassembly of the firearm. The cylinder has an exhaust port on a side of the cylinder in fluid communication with a port in a side wall of the gas block. Exhaust gas is expelled from a side wall of the gas block and offset from a sight line of the firearm.

In accordance with another exemplary embodiment, a system for removably securing a hand guard to a semi-automatic or automatic rifle is provided. The system having: a first locking assembly for removably coupling a rear end of the hand guard to an upper receiver of the rifle; a second locking assembly for removably coupling a forward end of the hand guard to the rifle; and wherein the first locking assembly and the second locking assembly axially and rotationally position the hand guard with respect to the rifle and wherein the hand guard is not directly secured to a barrel of the rifle.

In another exemplary embodiment, a semi-automatic or automatic rifle is provided. The rifle having: a system for removably securing a hand guard to the rifle, the system comprising: a first locking assembly for removably coupling a rear end of the hand guard to an upper receiver of the rifle; a second locking assembly for removably coupling a forward end of the hand guard to the rifle; and wherein the first locking assembly and the second locking assembly axially and rotationally position the hand guard with respect to the rifle and wherein the hand guard section is not directly secured to a barrel of the rifle.

In yet another embodiment, a method for removably securing a hand guard to a semi-automatic or automatic rifle is provided. The method including the steps of: removably coupling a rear end of the hand guard to an upper receiver of the rifle with a first locking assembly; removably coupling a forward end of the hand guard to the rifle with a second locking assembly; and wherein the first locking assembly and the second locking assembly axially and rotationally position the hand guard with respect to the rifle and wherein the hand guard is not directly secured to a barrel of the rifle.

In yet another embodiment, a semi-automatic or automatic rifle is provided. The rifle having: an upper hand guard and a lower hand guard each removably secured to an upper receiver of the rifle, wherein the upper hand guard has an integral upper rail that extends along an upper surface of the upper hand guard and the upper hand guard has a rear tab that is received within a mating slot of the upper receiver when the upper hand guard is secured to the upper receiver and wherein the upper rail of the upper hand guard is contiguous with a receiver rail when the upper hand guard is secured to the upper receiver; a cap configured to releasably engage a forward end of the upper hand guard and a forward end of the lower hand guard; and wherein the upper hand guard and the lower hand guard are not directly secured to a barrel of the rifle such that the upper hand guard and the lower hand guard float in position relative to the barrel of the rifle.

In yet another embodiment, a method for removably securing a hand guard to a semi-automatic or automatic rifle is provided. The method including the steps of: removably coupling a rear end of an upper hand guard to an upper receiver of the rifle; removably coupling a rear end of a lower hand guard to an upper receiver of the rifle; removably coupling a forward end of the upper hand guard and a forward end of a lower hand guard to a cap, wherein the upper hand guard and the lower hand guard are not directly secured to a barrel of the rifle such that the upper hand guard and the lower hand guard float in position relative to the barrel of the rifle and wherein the upper hand guard has an integral upper rail that extends along an upper surface of the upper hand guard and the upper hand guard has a rear tab that is received within a mating slot of the upper receiver when the upper hand guard is secured to the upper receiver and wherein the upper rail of the upper hand guard is contiguous with a receiver rail when the upper hand guard is secured to the upper receiver.

BRIEF DESCRIPTION OF THE DRAWINGS

The foregoing aspects and other features of the exemplary embodiments are explained in the following description, taken in connection with the accompanying drawings, wherein.

DETAILED DESCRIPTION

Figure 1:
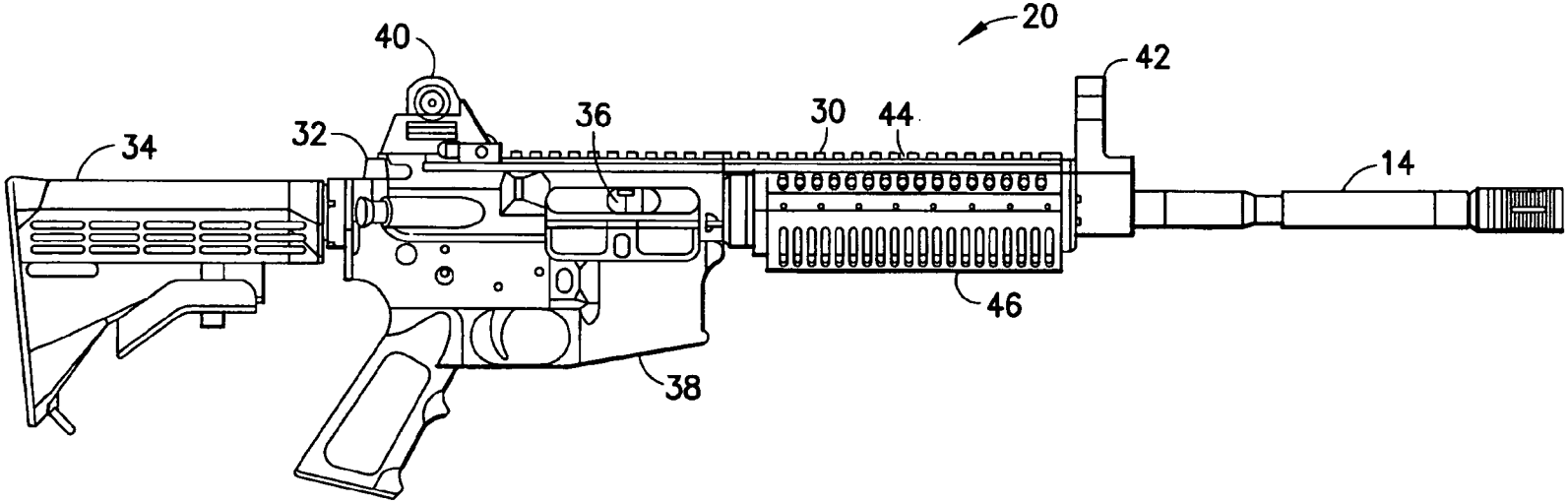
FIG. 1 is a side elevation view of an automatic firearm incorporating features in accordance with an exemplary embodiment.

Referring to FIG. 1, there is shown, a side elevation view of an automatic firearm 20 capable of automatic or semiautomatic fire incorporating features in accordance with an exemplary embodiment. Although the present invention will be described with reference to the embodiments shown in the drawings, it should be understood that the present invention can be embodied in many alternate forms of embodiments. In addition, any suitable size, shape or type of elements or materials could be used.

Firearm 20 is illustrated as generally having what is known generally as a "black rifle" configuration. The black rifle configuration being the family of rifles developed by Eugene Stoner, for example, such as an M4™ (available from Colt Defense, LLC) or M16 type automatic firearm configuration. However, the features of the disclosed embodiments, as will be described below, are equally applicable to any desired type of automatic firearm. Firearm 20 may have operational features such as disclosed in U.S. Pat. Nos. 5,726,377, 5,760,328, 4,658,702 and 4,433,610, and patent application Ser. Nos. 60/564,895; 10/836,443 filed respectively on Apr. 23, 2004 and Apr. 30, 2004, all of which are hereby incorporated by reference herein in their entirety. The firearm 20 and its sections described in greater detail below is merely exemplary, and in alternate embodiments the firearm 20 may have other sections, portions or systems. For example the firearm 20 may also include one or more features described and shown in U.S. Application No. 60/772,494, filed Feb. 9, 2006; and/or, U.S. application Ser. No. 11/231,063, filed Sep. 19, 2005; and/or U.S. application Ser. No. 11/339,187, filed Jan. 25, 2006, and/or U.S. application Ser. No. 11/352,036, filed Feb. 9, 2006, all of which are hereby incorporated by reference in their entirety.

In the exemplary embodiment, firearm 20 may incorporate a removable hand guard 30 having upper hand guard 44 and lower hand guard 46, a receiver section 32 having upper receiver 36 and lower receiver 38, a barrel 14, stock 34, rear sight 40 and front sight 42. Hand guard 30 may further incorporate vent holes, ribbing, heat shields or double heat shields and liners to facilitate cooling of the barrel 14 while keeping hand guard 30 at a temperature sufficient for an operator to hold the hand guard. In the embodiment shown, hand guards 44, 46 are shown as removable hand guards mounted to the barrel assembly 14 where the top rail on the hand guard 44 is aligned with the upper receiver rail (see FIGS. 1 and 4). Although hand guards 44, 46 may be made from any suitable material, such as metal, it should be noted that any suitable material such as plastic, composites or any suitable combination of materials may be provided. Hand guard 30 may have features such as disclosed in U.S. Pat. Nos. 4,663,875 and 4,536,982, both of which are hereby incorporated by reference herein in their entirety. In the exemplary embodiment, hand guard 30 may have an aluminum shell and having vent holes and external ribbing. Hand guard 30 may be ergonomically sized to allow a user to comfortably grip the guard. In alternate embodiments, multiple shells, inner ribbing, heat shields or double heat shields and liners to facilitate cooling of the barrel 14 while keeping hand guard 30 at a temperature sufficiently low for an operator could be provided. In alternate embodiments, removable and relocatable rails may be provided on hand guard 30 and may be permanently mounted or removably mounted and be removable or moveable to different locations on hand guard 30. The rails and mounting system to the hand guard may be substantially similar to rails described in U.S. patent application Ser. No. 11/113,525 filed Apr. 25, 2005, which is incorporated by reference herein in its entirety. In alternate embodiments, rails may be in different locations with different sizes. Hand guard 30 and receiver section 32 may be configured to support such rails as a "Picatiny Rail" configuration as described in Military Standard 1913, which is hereby incorporated by reference herein in its entirety. The rails may be made from any suitable material such as hard coat anodized aluminum as an example. In the exemplary embodiment, front sight assembly 42 is shown mounted to barrel 14 (see FIG. 1). In alternate embodiments, front sight assembly 42 may be removable, allowing alternate mounting of desired accessory in its place such as a telescopic sight or laser sight. Rear sight assembly 40 is provided and mounted to receiver section 32. Rear sight assembly 40 may incorporate a sight ring and sight adjustment knobs provided to adjust the position of sight ring relative to the barrel 14 and front sight 42 for accurate target sighting.

Figure 2:
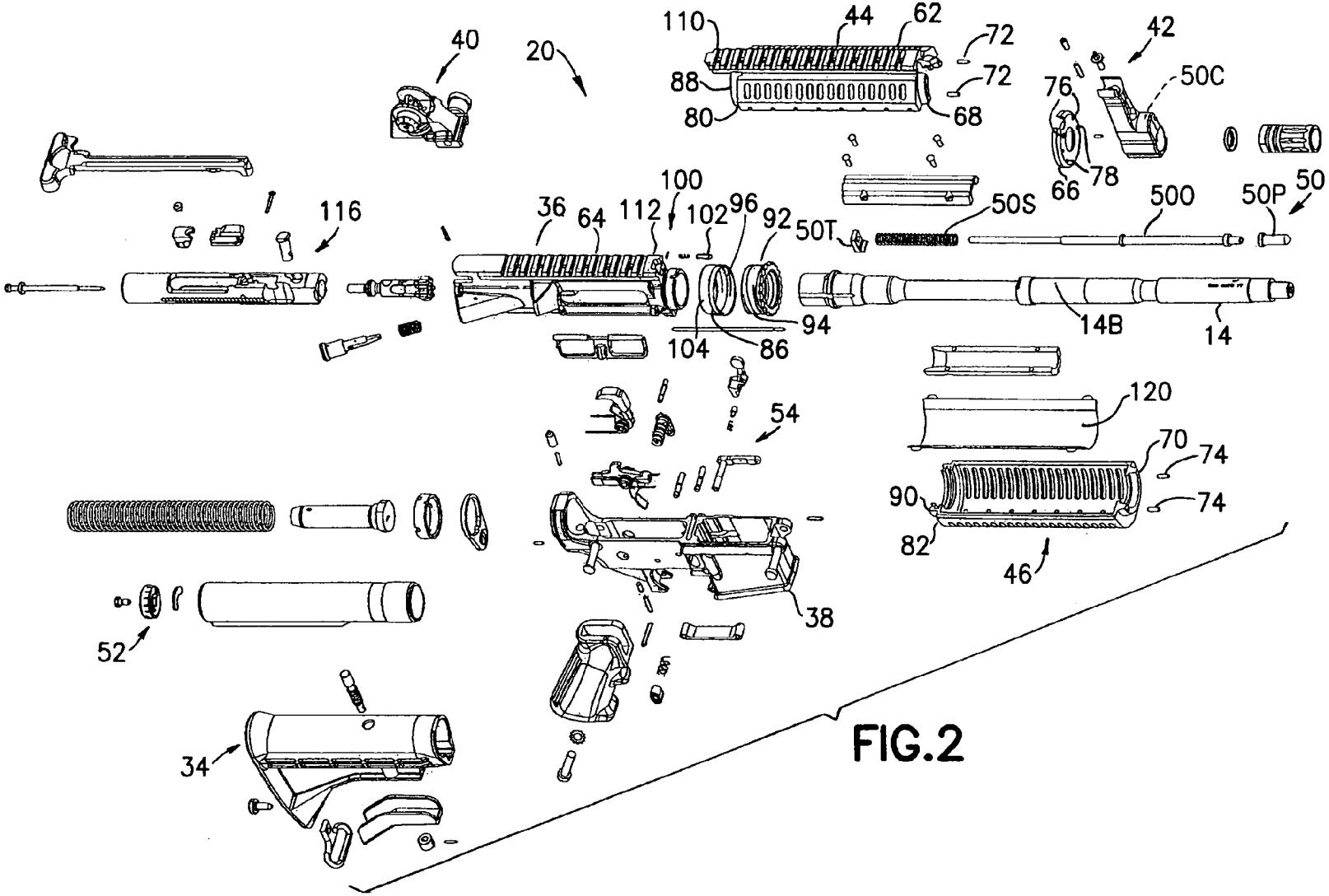
FIG. 2 is an exploded isometric view of the automatic firearm shown in FIG. 1.

Referring now to FIG. 2, there is shown an exploded isometric view of the automatic firearm 20 shown in FIG. 1. As noted before the modular auto or semiautomatic rifle 30 may incorporate any one or more of the many features in U.S. Application No. 60/772,494, filed Feb. 9, 2006, U.S. application Ser. No. 11/231,063, filed Sep. 19, 2005, U.S. application Ser. No. 11/339,187, filed Jan. 25, 2006 U.S. application Ser. No. 11/352,036, filed Feb. 9, 2006, U.S. Application No. 60/610,703, filed Sep. 17, 2004, U.S. application Ser. No. 11/672,189, filed Feb. 7, 2007, U.S. application Ser. No. 11/154,738, filed Jun. 16, 2005, and U.S. Application No. 60/646,875, filed Jan. 25, 2005, all of which are hereby incorporated by reference in their entirety. For example, the firearm 20 may incorporate a gas piston system 50 generally similar to embodiments in U.S. application Ser. No. 11/231,063 filed Sep. 19, 2005 previously incorporated by reference in its entirety. As a further example, the rifle may include a rear regulator 52, for example as shown U.S. application Ser. No. 11/339,187 also previously incorporated by reference in its entirety. The firearm may be provided with "over the beach" capability allowing immediate firing of the weapon after water submersion regardless of weapon orientation. In alternate embodiments, a folding stock may be provided increasing weapon versatility by reducing the overall length to shoulder width. A folding stock further may enhance weapon balance for stability and to retain a target during firing. Greaseless fire control system parts 54 may be provided. For example, the fire control system parts may be coated with a coating, such as UCTD UltraCem R coating to eliminate the need for lubrication and to reduce the accumulation of foreign material and residue and to provide ease in cleaning. As may be realized, the gas piston system operates to effect automatic loading of rounds into the firing chamber of the barrier 14. The gas piston system 50 may generally include a gas cylinder 506 (described in greater detail below, and a piston 50P that is connected to a spring loaded operating rod system (e.g. including rod 500, spring 505 and spring stop 50T). Removal of the gas piston system 50 may be facilitated in the exemplary embodiment by the removable hand guards 30 as will be described below. In other exemplary embodiments, gas piston system removal may be effected through the front without removal of the hand guards or in the event upper receiver is of unitary construction with an integral hand guard, as will also be described below.

Referring still to FIG. 2, in the embodiment shown, forward extending hand guard/rail system 30 is provided. Hand guard is shown removable yet may be functionally comparable to and with similar alignment features as a one-piece upper receiver extended rail system due to the stabilization design approach (a suitable example of a one-piece upper receiver with integral hand guard section is shown in U.S. application Ser. No. 11/352,036 previously incorporated by reference in its entirety). In the embodiment shown, the rail system/hand guard 30 provides independent movement from the upper receiver and floats with the barrel 14 to increase accuracy and optimizes axis rail mounting options for accessory tailoring and operator handling comfort. The guard is shown as a split guard having upper 36 and lower 38 sections that may be removable. Heat shields may be provided similar to (for example shield described in U.S. application Ser. No. 11/352,036, previously incorporated by reference in its entirety). The heat removal bleeding system protects the operator from barrel heat, increases sustained rate of fire and extends the barrel life. The upper hand guard is shown unitary with integral upper rail 62 (see also FIGS. 11A-11D). The upper rail interfaces with and is integrated with the upper receiver 36 upper rail 64 when upper hand guard 44 is mounted. Cap or cover 66 (see also FIGS. 13A-13B) is provided on barrel 14 and interfaces with the front 68, 70 of the removable hand guard sections 44, 46. In the exemplary embodiment the guards 44, 46 and the cap 66 may have complementing conical tapered radially locating features 68, 70 that locate and fix the hand guards, eliminating play in the guard mount. In alternate embodiments, the guard mounting to the cap and barrel could have any other radially locating and/or fixing features engaged by longitudinal displacement of the guard. In the exemplary embodiment the upper 44 and lower 46 guards and cap 66 having interlocking facets, for example, in the embodiment shown, a pin 72, 74 and hole 76, 78 system for rotational positioning. In alternate embodiments, other surfaces, for example, conical surfaces may be provided for radial fixing and/or may be added to pins and holes to simultaneously locate and lock the hand guards in position both in axial, radial and rotational directions.

The rear portions 80, 82 of the hand guards are removably attached to the receiver 36. In the embodiment shown, attachment of the upper 44 and lower 46 hand guards to the receiver 36 utilizes a tapered radial interlocking rabbett fit between a barrel nut collar 86 and a V-groove 88, 90 at the rear 80, 82 of the guards 44, 46. Here, the v-groove 88, 90 at the rear of the guard interfaces with the barrel nut assembly to removably lock the guards in place. The barrel nut assembly has a barrel nut 92 (see also FIGS. 8A-8B) and an outer collar (see also FIGS. 9A-9B) threaded onto the barrel nut. Here, the barrel nut has external threads 94 that mate with corresponding thread 96 of the collar 86 for threading the outer collar. In order to engage the guards 44, 46, the outer collar 86 is threaded forwards to engage guards 44, 46. Referring now also to FIGS. 10A-10C, in the exemplary embodiment the upper receiver 36 may be provided with a manual lock actuator 100 to lock the collar 86 in place after rotation of the collar 86. In the embodiment shown, the manual lock 100 comprises a spring loaded pin 102, biased forwards that engages the collar 86. Here, a thumb pad or any other suitable manual grip may be provided to pull actuator/spring loaded pin 102 back (in the direction indicated by arrow B in FIG. 10A), to an open position. The actuator 100 may be locked into the open position against the spring bias, by a second spring loaded detent (as will be described further below). In the embodiment shown a roll pin engaging detent 166 is provided. In alternate embodiments, other suitable actuator, locking device or detent could be provided. The spring loaded pin 102, in the closed position, engages a saw tooth feature 104 (see FIG. 9B) on the collar 86 to prevent rotation of the collar 86 after locking the hand guards 44, 46 in position. Removal of the hand guards 44, 46 may be effected for example by pulling the thumb pad back (to the open position), rotating the collar 86 away from the guards 44, 46, thus disengaging the v-groove portions 88, 90 of the guards 44, 46. In the embodiment shown, the hand guard 44, 46 floats with the barrel 14 with the upper rail 62 of the upper hand guard 44 substantially continuous with receiver rail 64. A rear tab 110 on the hand guard upper rail engages a mating slot 112 on upper receiver rail similar to U.S. application Ser. No. 11/231,063.

In the embodiment shown, a gas block 42 of unitary construction with an integral sight may be provided. Providing a fixed or folding sight as shown enables an operator's natural eye capability to align two radial objects for more rapid target acquisition and firing accuracy. In either embodiment, provisions may be made for mounting and removal of the gas piston system 50, including the removable operating rod and piston assembly from a front of the sight block (e.g. to allow removal without dismounting the hand guards). In either embodiment, a gas exhaust slot & groove with an exhaust port may be provided as will be described in greater detail below. In the exemplary embodiment, the slot extending along an outer side surface of the block and may reduce the possibility of dirt clogging exhaust port as will also be described further below. In alternate embodiments, the exhaust port may be located anywhere and hidden in an exhaust channel so that the port is not directly exposed to dirt. The exhaust channel may have an extended outlet opening so that gas may exhaust through any part of channel that is not blocked. The gas piston system directs gas bleed off to the front of the weapon, decreasing barrel heat and reducing carbon and powder residue accumulation for cleaner functioning. Additionally, the gas piston system reduces gas signature visibility and removes easily in the field for cleaning A bayonet mount lug BMT see FIGS. 17D-17E may be provided as a portion of the block or otherwise.

Figure 3A:
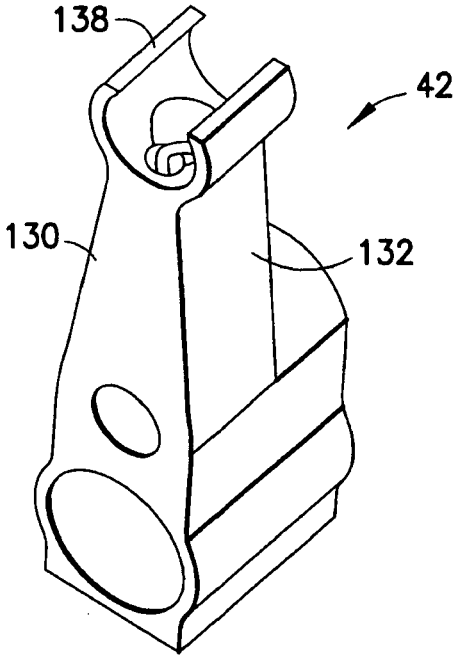
FIG. 3A is an isometric view of the front sight section of the firearm shown in FIG. 1.
Figure 3C:
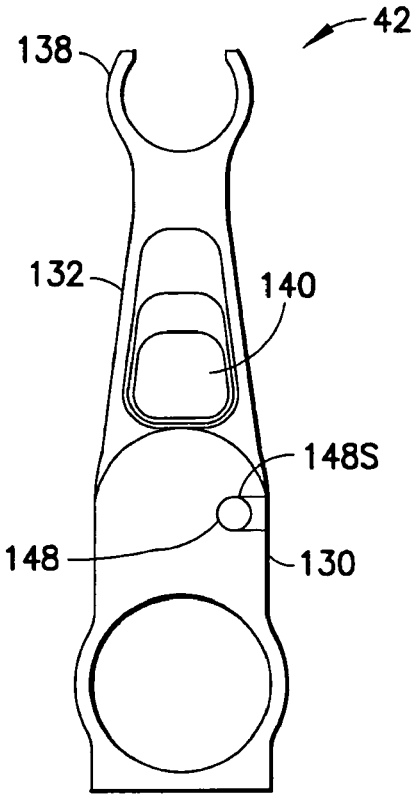
FIG. 3C is a front view of the front sight shown in FIG. 3A.
Figure 3B:
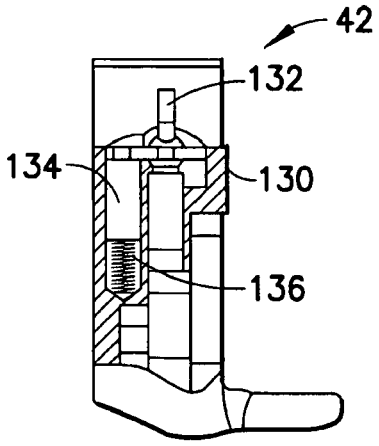
FIG. 3B is a partial section view of the front sight shown in FIG. 3A.
Figure 3D:
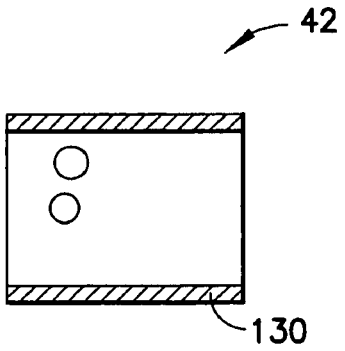
FIG. 3D is a bottom view of the front sight shown in FIG. 3A.
Figure 3E:
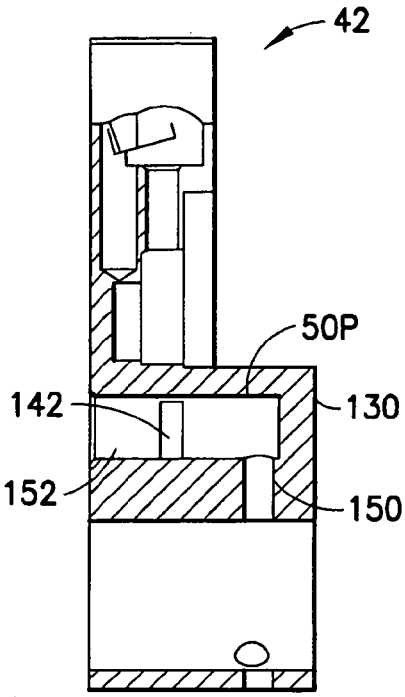
FIG. 3E is a section view of the front sight shown in FIG. 3A.
Figure 3F:
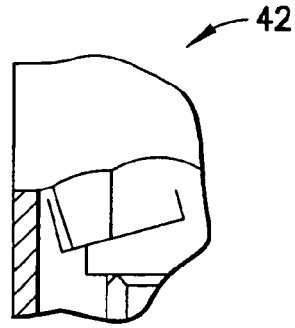
FIG. 3F is a partial section view of the front sight shown in FIG. 3A.
Figure 3G:
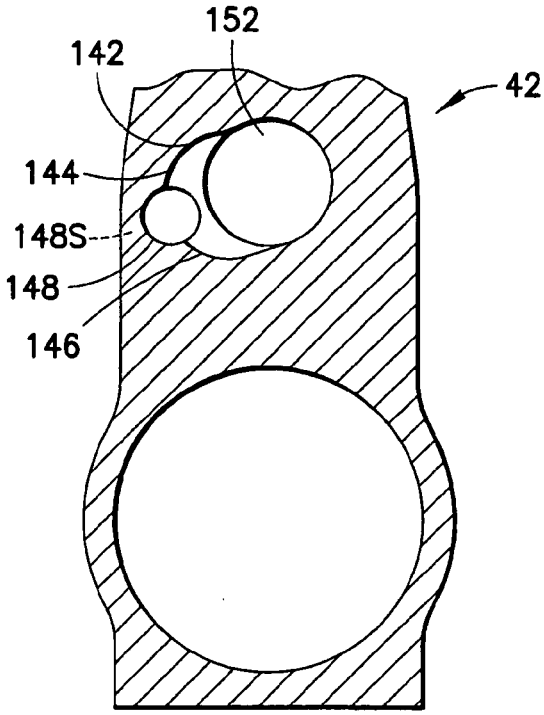
FIG. 3G is a partial section view of the front sight shown in FIG. 3A.

Referring now to FIG. 3A there is shown an isometric view of the front sight section of the firearm 20 shown in FIGS. 1-2. Referring also to FIG. 3B, there is shown a partial section view of the front sight shown in FIG. 3A. Referring also to FIG. 3C, there is shown a front view of the front sight shown in FIG. 3A. Referring also to FIG. 3D, there is shown a bottom view of the front sight shown in FIG. 3A. Referring also to FIG. 3E, there is shown a section view of the front sight shown in FIG. 3A, referring also to FIG. 3F, there is shown a partial section view of the front sight shown in FIG. 3A. Referring also to FIG. 3G, there is shown a partial section view of the front sight shown in FIG. 3A. Front sight assembly 42 generally comprises base section 130, front sight post 132 and a spring loaded pivot or detent assembly 134 spring loaded by spring 136. In the exemplary embodiment shown in FIGS. 3A-3E, front sight 42 may comprise a gas block having an integral sight, for example such as disclosed in U.S. application Ser. No. 11/352,036 and/or U.S. Application No. 60/772,494 and/or U.S. application Ser. No. 11/231,063 all of which were previously incorporated by reference herein in their entirety. In the exemplary embodiment shown in FIGS. 3A-3D, the front sight post 132 has a rounded rim or edge feature 138 that is shaped to substantially coincide with the edges of the hole or ring in rear sight 30 upon alignment of front and rear sights making it easier for a user to acquire targets and center the weapon with the combination. In the exemplary embodiment shown in FIGS. 3A-3D, the front sight 42 is shown as a fixed sight, wherein the gas block 42 may be of unitary construction with the sight integral thereto, and where material may be removed in recessed section 140 for weight reduction. The arrangement of the sight post on the gas block is representative, and in alternate embodiments the gas block and sight post may have any suitable arrangement. As seen best in FIG. 3E, in the exemplary embodiment, the base portion 130 of the gas block may define the gas cylinder portion 50C (see FIG. 2) of the gas piston system 50. Base 130 may have a closed cylinder 152 (closed at the front end, and forming a piston opening at the back end for piston 50P. As seen best in FIG. 3G, a gas exhaust aperture or slot 142 may be formed in a cylinder side, and groove 144 with an exhaust port 146 may be provided. In the exemplary embodiment shown, the exhaust port 146 may have a forward facing opening 148 (see FIG. 3C. The opening is offset from the front end of the gas cylinder and from the bore sight line of the firearms. The exhaust port opening may be hidden in a slotted channel 148S. Here, a slot 148S extending along the outside of block 130 is provided reduces the possibility of dirt clogging exhaust port opening 148. In alternate embodiments, the exhaust port may be located anywhere, for example, hidden in an exhaust channel so that the port is not directly exposed to dirt. The exhaust channel may have an extended outlet opening so that gas may exhaust through any part of channel that is not blocked. As may be realized, in the exemplary embodiment, the gas piston system directs gas bleed off through port 150 to cylinder 152 through side slot 142 to port 148 directed to the front of the weapon.

Figure 4:
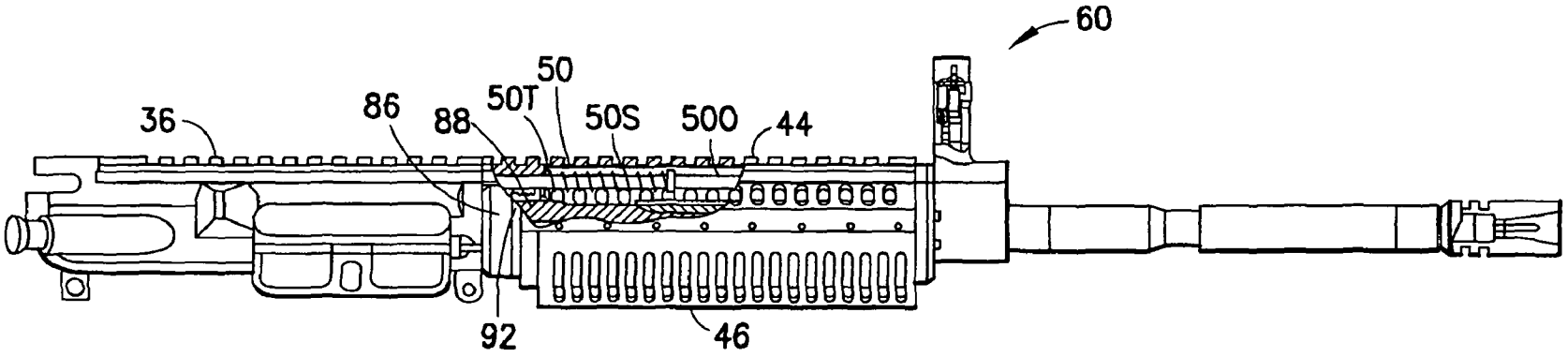
FIG. 4 is a partial side elevation view of the automatic firearm shown in FIG. 1 having an alternate embodiment sight.
Figure 5A:
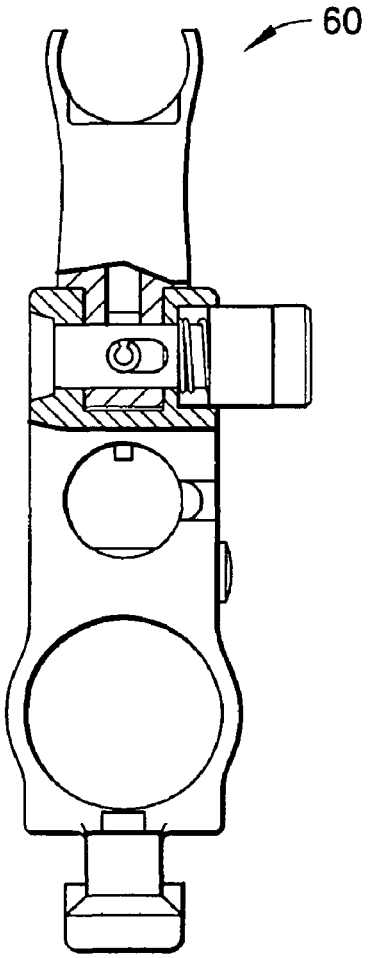
FIG. 5A is a partial section side view of the alternate embodiment sight shown in FIG. 4.
Figure 5B:
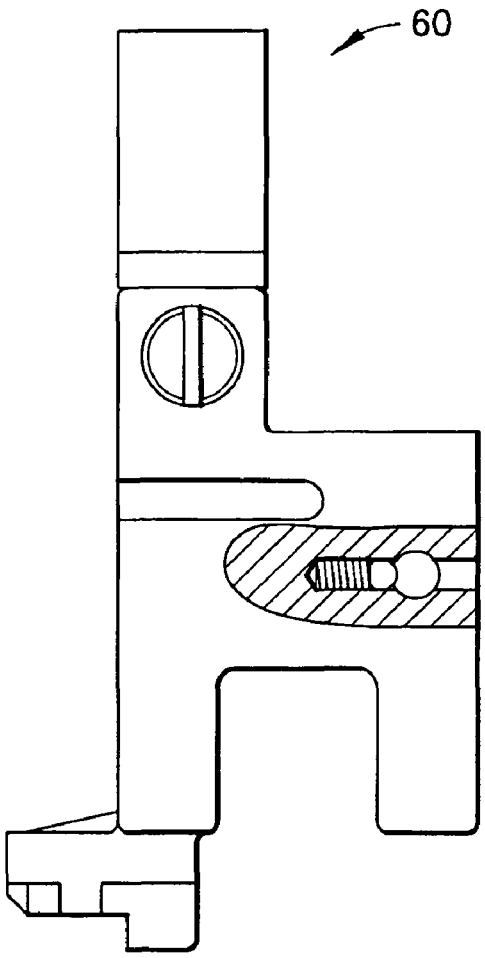
FIG. 5B is a partial section front view of the alternate embodiment sight shown in FIG. 4.

Referring now to FIG. 4, there is shown a partial side elevation view of the automatic firearm shown in FIG. 1 having sight 60 in accordance with another exemplary embodiment. Referring also to FIG. 5A, there is shown a partial section side view of the alternate embodiment sight 60 shown in FIG. 4. Referring also to FIG. 5B, there is shown a partial section front view of the alternate embodiment sight 60 shown in FIG. 4. In the embodiment shown, gas block 60 may have an integral folding sight, for example such as disclosed in U.S. application Ser. No. 11/352,036 and/or U.S. Application No. 60/772,494 and/or U.S. application Ser. No. 11/231,063 all of which were previously incorporated by reference herein in their entirety, and will be described in greater detail below.

Figure 6:
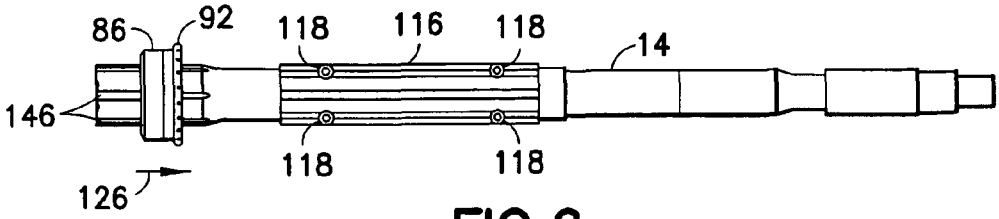
FIG. 6 is an elevation view of a barrel assembly of the automatic firearm shown in FIG. 1.
Figure 7:
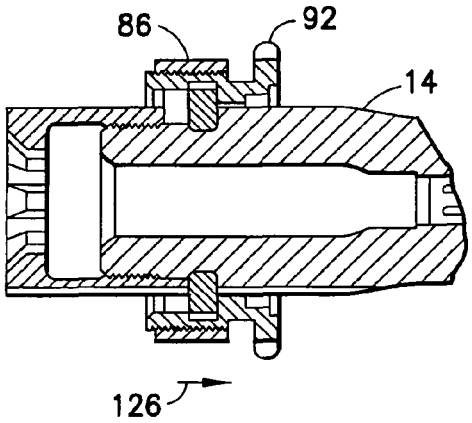
FIG. 7 is a partial section view of the barrel assembly shown in FIG. 6.

Referring now to FIG. 6, there is shown an elevation view of a barrel assembly of the automatic firearm shown in FIG. 1. Referring also to FIG. 7, there is shown a partial section view of the barrel assembly shown in FIG. 6. Barrel 14 has radiator 116 assembled there to. In this embodiment, radiator 116 is an assembly of two substantially similar parts. As may be realized from FIG. 2, air may be forced from the receiver by the bolt assembly action, through grooves 146 in the barrel (illustrated for example purposes in FIG. 6), and directed over the fins of radiator 116. Referring also to FIGS. 12 and 13, Cooling holes or slots in the hand guard further aid convection cooling. Portions of radiator 116 may be fastened together, by screws 118 as an example. A bottom shield 120 may be removably mounted to radiator 116 to protect the hand of the user grasping the guard. The shield may be of any desired size and shape. The shield may be made of sheet metal curved to conform generally to the inside of guard 46. As noted before, the barrel nut assembly generally has a barrel nut 92 and an outer collar 86 threaded onto the barrel nut. Here, the barrel nut has external threads 94 that mate with corresponding thread 96 of the collar 86 for threading the outer collar. In order to engage the guards 44, 46, the outer collar 86 is threaded in a forward direction 126 to engage guards 44, 46 and substantially clamp the rear end 88, 90 of the guards between collar 86 and flange 94F of the barrel nut see also FIG. 4). The notched end of the collar faces in a direction opposite of direction 26 to engage the locking pin in the receiver.

Figure 8A:
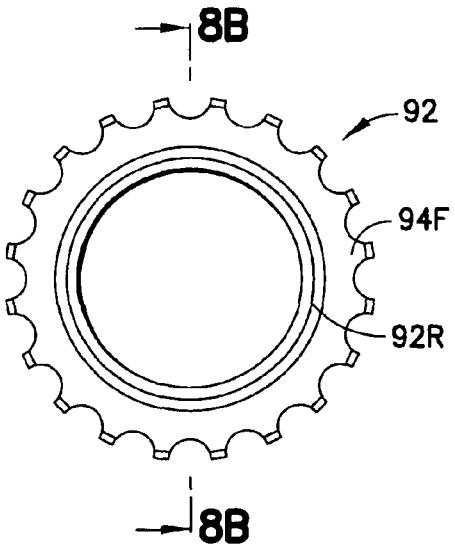
FIG. 8A is a front view of a barrel nut.
Figure 8B:
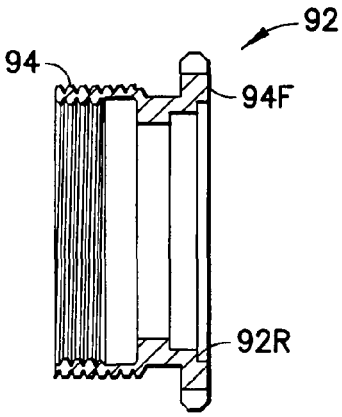
FIG. 8B is a section view of a barrel nut.

Referring now to FIG. 8A, there is shown a front view of a barrel nut 92. Referring also to FIG. 8B, there is shown a section view of a barrel nut. Barrel nut 92 has external threads 94 that mate with corresponding thread 96 of the collar 86 for threading the outer collar. Flange 94F is disposed to form a seating surface for the front facing surface of the rear end 88, 90 of the hand guards 44, 46, against which the rear end abuts when clamped by the outer collar 86 as previously described. In the exemplary embodiment, the barrel nut may include a seating detent 92R for the spring stop 50T of the gas system. The stop 50T may be held by detent 92R and the upper hand 65 and substantially as shown in FIG. 4.

Figure 9A:
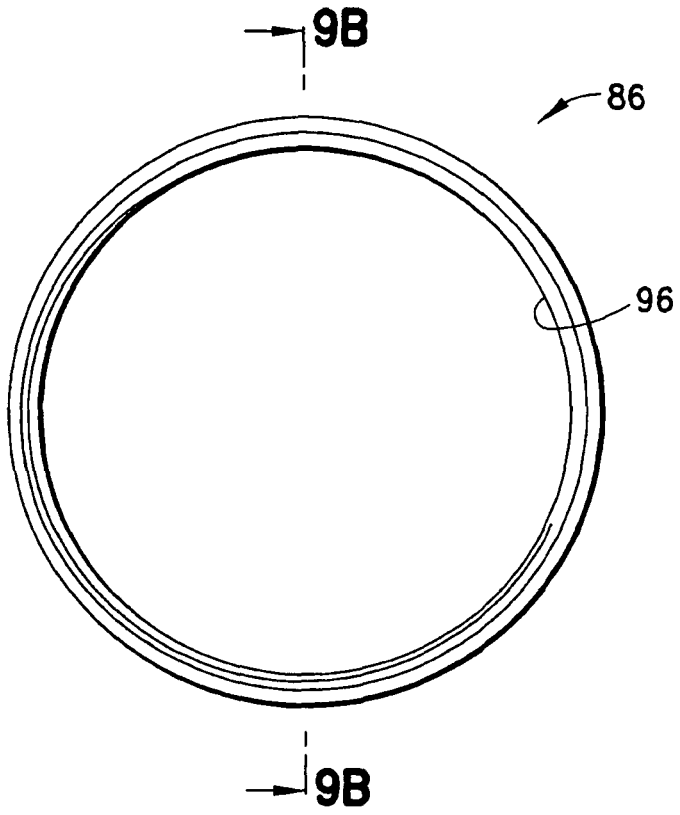
FIG. 9A is a front view of a barrel nut collar.
Figure 9B:
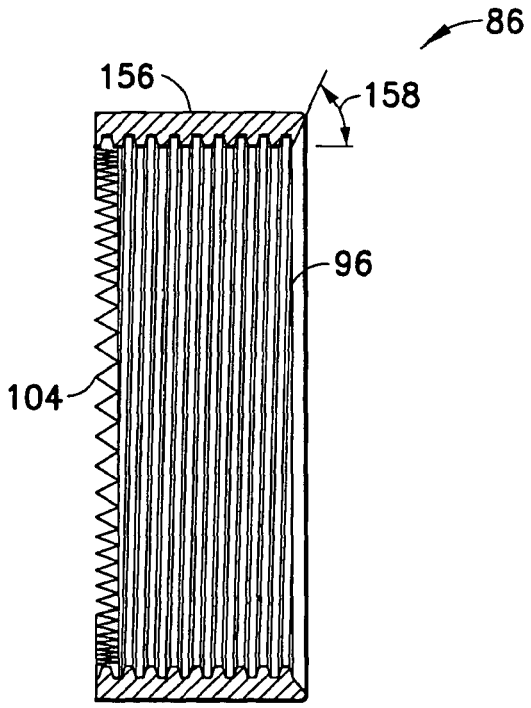
FIG. 9B is a section view of a barrel nut collar.
Figure 10A:
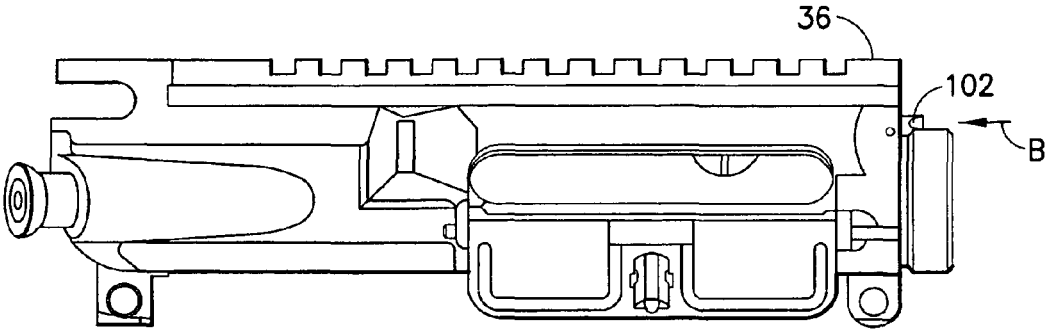
FIG. 10A is an elevation view of an upper receiver.
Figure 10B:
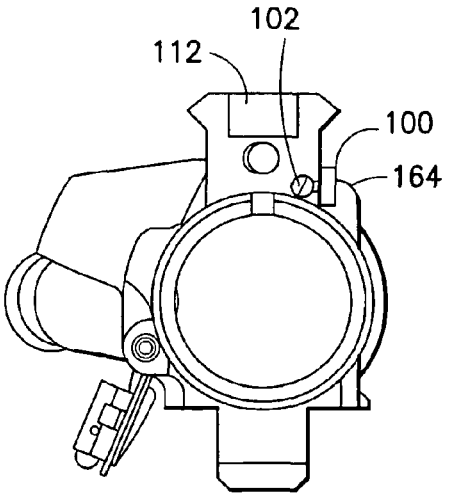
FIG. 10B is a front view of an upper receiver.
Figure 10C:
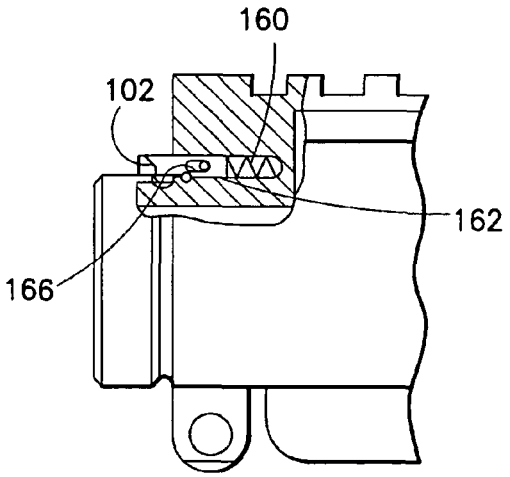
FIG. 10C is a partial section view of an upper receiver.

Referring now to FIG. 9A, there is shown a front view of a barrel nut collar. Referring also to FIG. 9B, there is shown a section view of a barrel nut collar. The outer collar 86 threads onto the barrel nut. The external threads 94 of the barrel nut mate with corresponding internal thread 96 of the collar 86. As noted before, the spring loaded pin 102 (see FIG. 2) engages a saw tooth feature 104 on the collar 86 to prevent rotation of the collar 86 after locking the hand guards 44, 46 in position. Outside diameter 156 of collar 86 may be knurled in order to allow the operator to better rotate collar 86 for hand guard removal. An annular chamfer 158 may be provided in collar 86 to prevent point contact of collar 86 with the V-grooves in the rear end 88, 90 of the hand guard sections.

Referring now to FIG. 10A, there is shown an elevation view of an upper receiver 44. Referring also to FIG. 10B, there is shown a front view of an upper receiver 44. Referring also to FIG. 10C, there is shown a partial section view of an upper receiver 36. As noted before, in the exemplary embodiment, the upper receiver may be provided with a manual lock actuator 100 to lock the collar 86 in place after rotation of the collar 86. In the embodiment shown, the manual lock 100 comprises a spring loaded pin 102, biased forwards that engages the collar 86. Spring loaded pin is spring loaded by spring 160 located in bore 162. Thumb pad 164 or any other suitable manual grip may be provided to pull actuator/spring loaded pin 102, locking the actuator 100 into the open position against the spring bias of second spring loaded detent 166 as previously described.

Figure 11A:
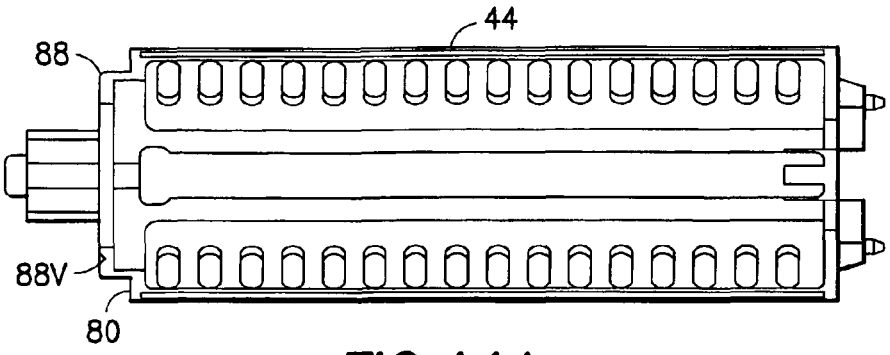
FIG. 11A is a bottom view of an upper hand guard.
Figure 11B:
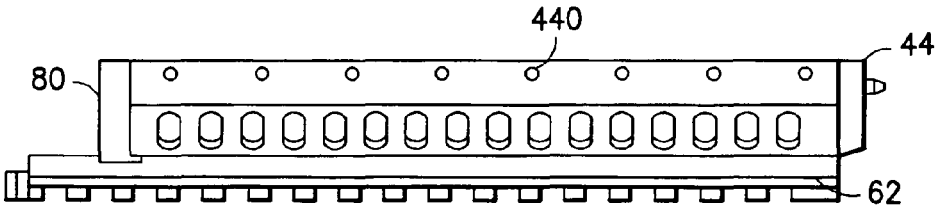
FIG. 11B is a side view of an upper hand guard.
Figure 11C:
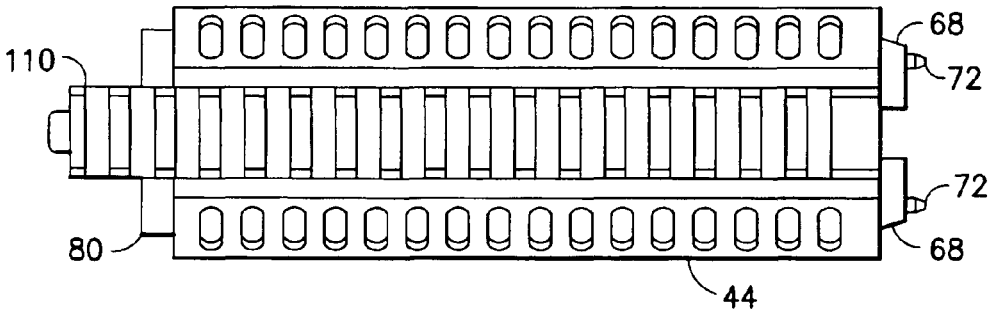
FIG. 11C is a top view of an upper hand guard.
Figure 11D:
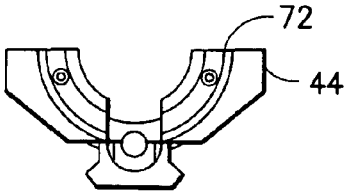
FIG. 11D is an end view of an upper hand guard.

Referring now to FIG. 11A, there is shown a bottom view of an upper hand guard 44 in accordance with an exemplary embodiment. Referring also to FIG. 11B, there is shown a side view of the upper hand guard. Referring also to FIG. 11C, there is shown a top view of the upper hand guard, and in FIG. 11D, there is shown an end view of the upper hand guard. As shown in FIG. 2, and noted before, cap 66 may be provided on barrel 14 to interface with the front 68 of the removable hand guard section 44. In the exemplary embodiment guard 44 and cap 66 may have complementing conical tapered, radially locating features 68, 124 (see also FIG. 13B) that fix the hand guard, eliminating lateral and longitudinal play in the guard mount. In alternate embodiments, the guard mounting to the cap and barrel could have any other radially locating and/or fixing features engaged by longitudinal displacement of the guard. As noted before, the upper 44 guard and cap 66 may have interlocking facets, for example, in the embodiment shown, a pin 72 and hole 76 system for rotational positioning. In alternate embodiments, other surfaces, for example, conical surfaces may be provided for radial fixing and/or may be added to pins and holes to simultaneously locate and lock the hand guards in position both in both axial, radial and rotational direction. As previously described, the rear portion 80 of the hand guard is removably attached to the receiver 36. In the embodiment shown, the rear of the hand guard may have walls or flanges for attachment of the upper 44 hand guard to the receiver 36 that have tapered radial interlocking rabbett fit between a barrel nut collar 86 and a V-groove 88V at the rear 80 of the guard 44. Here, the v-groove 88V at the rear of the guard interfaces with the barrel nut assembly to removably lock the guards in place. A rear tab 110 on the hand guard upper rail engages a mating slot 112 on upper receiver rail similar to U.S. application Ser. No. 11/231,063 previously incorporated by reference in its entirety. Holes 440 may be formed along the sides of the hand guard allowing for fastening of accessory devices (with screws or pins) to the hand guard.

Figure 12A:
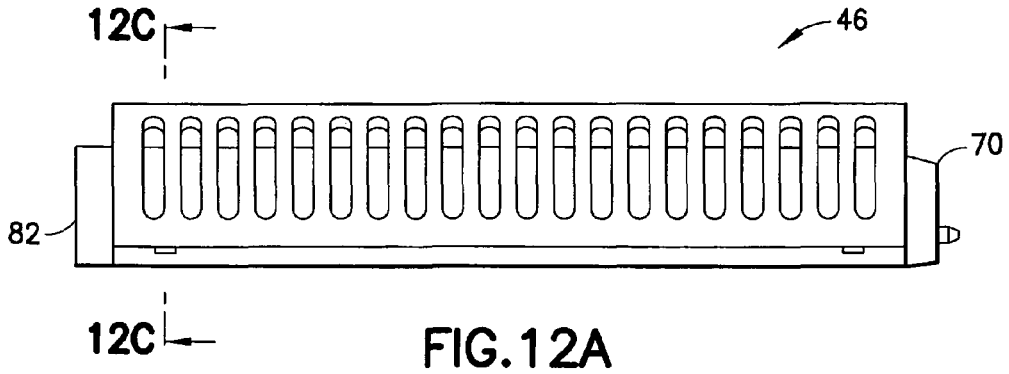
FIG. 12A is a side view of a lower hand guard.
Figure 12B:
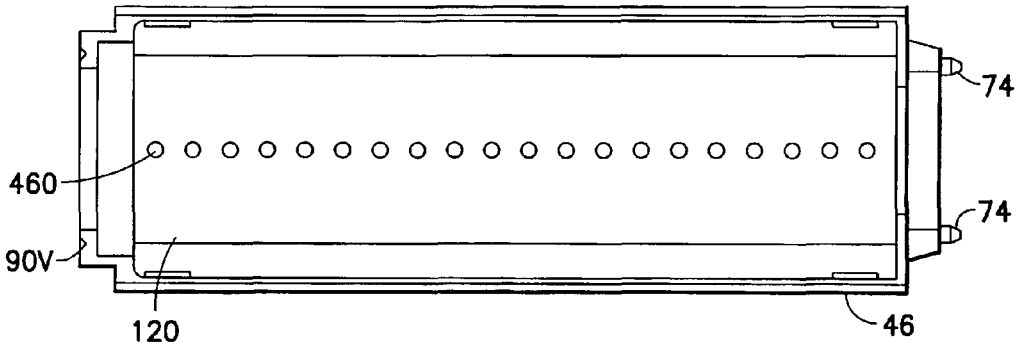
FIG. 12B is a top view of a lower hand guard.
Figure 12C:
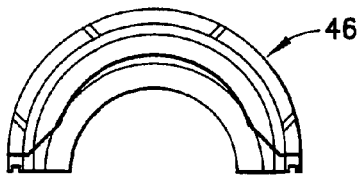
FIG. 12C is an end view of a lower hand guard.

Referring now to FIG. 12A, there is shown a side view of a lower hand guard. Referring also to FIG. 12B, there is shown a top view of a lower hand guard. Referring also to FIG. 12C, there is shown an end view of a lower hand guard. The lower hand guard is generally similar to that shown in U.S. application Ser. No. 11/231,063 previously incorporated by reference in its entirety. In the exemplary embodiment, the lower hand guard 46 may have a rounded bottom grip surface. The lower hand guard 46 as noted before may have multiple fastener and/or accessory mount locations for mounting accessories, for example a handgrip, grenade launcher or otherwise. The lower hand guard has multiple fastener holes that allow for mounting of accessories, for example, mounting of grenade launcher to lower guard or other accessories. As previously noted, cap 66 is provided on barrel 14 and interfaces with the front 70 of the removable hand guard section 46 in a manner substantially similar to that described for upper hand guard 44. Guard 46 and the cap 66 have complementing conical tapered radially locating features 70, 124 that fix the hand guard, eliminating play in the guard mount. In alternate embodiments, the guard mounting to the cap and barrel could have any other radially locating and/or fixing features engaged by longitudinal displacement of the guard. The lower 46 guard and cap 66 have interlocking facets, for example, in the embodiment shown, a pin 74 and hole 78 system for rotational positioning. In alternate embodiments, other surfaces, for example, conical surfaces may be provided for radial fixing and/or may be added to pins and holes to simultaneously locate and lock the hand guards in position both in axial, radial and rotational directions. The rear portions 82 of the hand guard is generally similar to the rear end portions 80 of the upper hand guard for removably attaching the rear of the hand guard 46 to the receiver 36. In the embodiment shown, wall sections 90 for attachment of the lower 46 hand guard to the receiver 36, have a tapered radial interlocking rabbett fit between a barrel nut collar 86 and a V-groove 90V at the rear 82 of the guard 46. Here, the v-groove 90V at the rear wall 90 of the guard interfaces with the barrel nut assembly to removably lock the guards in place as previously described.

Figure 13A:
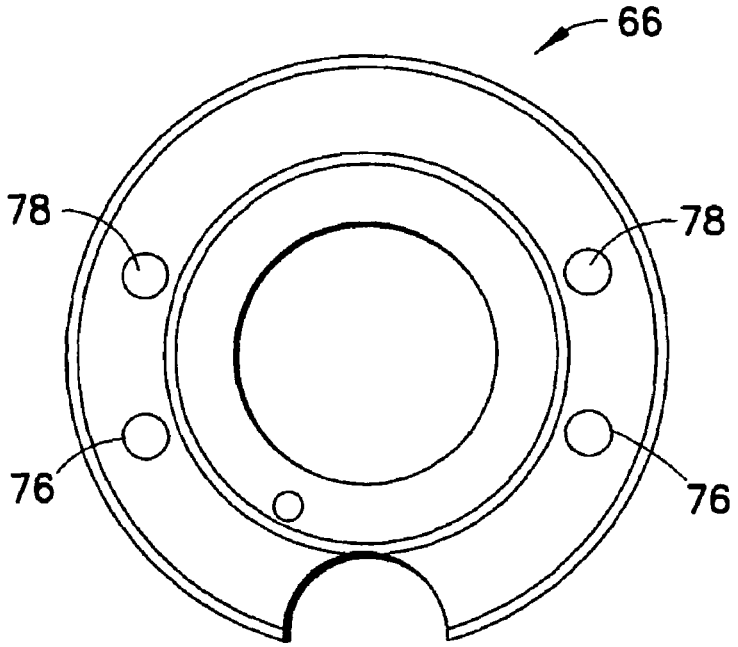
FIG. 13A is an end view of an end cap.
Figure 13B:
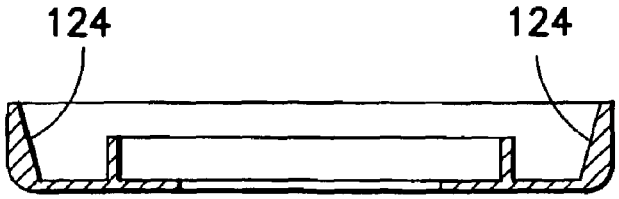
FIG. 13B is a section view of an end cap.

Referring now to FIGS. 13A-13B, there is shown respectively an end view and section view of the end cap 66. As noted before, cap 66 is provided fixed on barrel 14 and interfaces with the front 68, 70 of the removable hand guard sections 44, 46 As described (e.g. the guards 44, 46 and the cap 66 have complementing conical tapered radially locating features 68, 70 that mate with conical feature 124 of cap 66 that fix the hand guards, eliminating play in the guard mount).

Figure 14C:
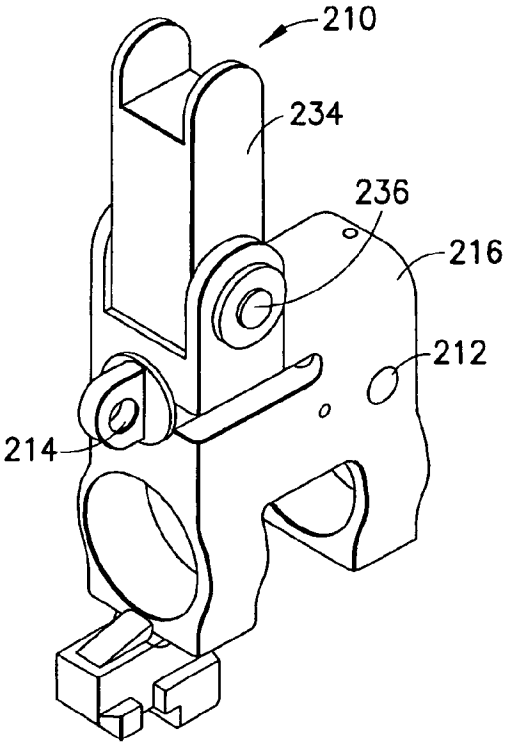
FIG. 14C is an isometric view of the alternate embodiment sight.
Figure 14B:
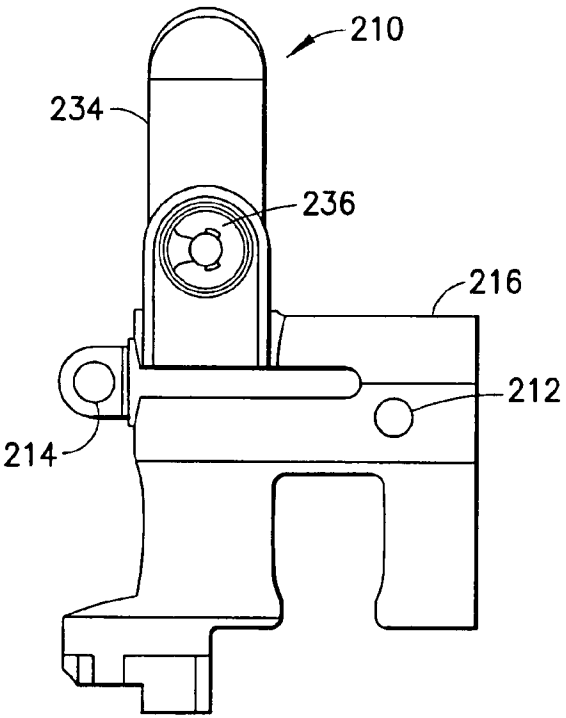
FIG. 14B is a side view of the alternate embodiment sight.
Figure 14A:
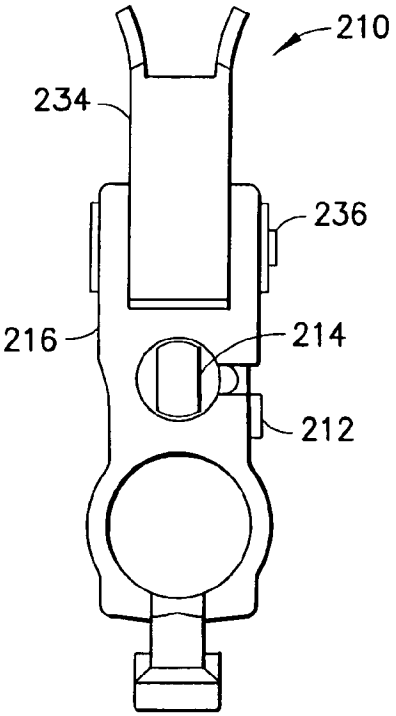
FIG. 14A is an end view of an alternate embodiment sight.
Figure 14D:
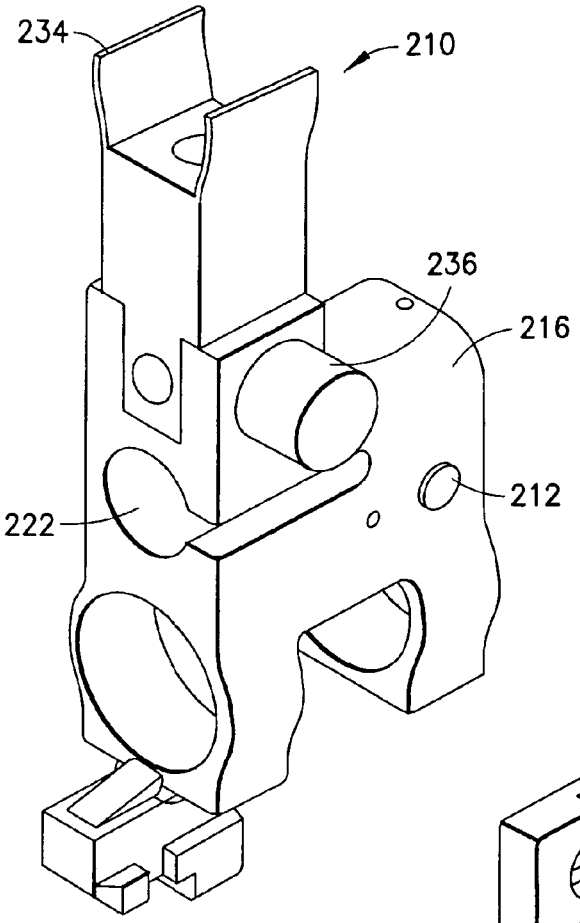
FIG. 14D is an isometric view of the alternate embodiment sight with the cylinder removed.
Figure 16C:
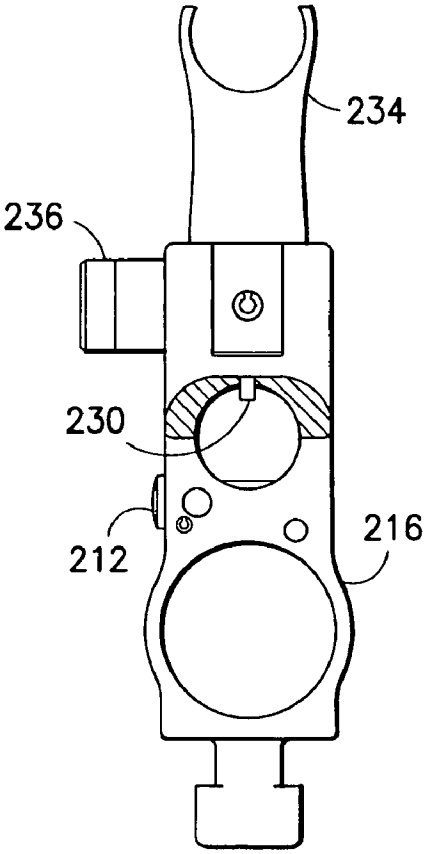
FIG. 16C is a rear view, partially in section of the alternate embodiment sight with the cylinder removed.
Figure 16B:
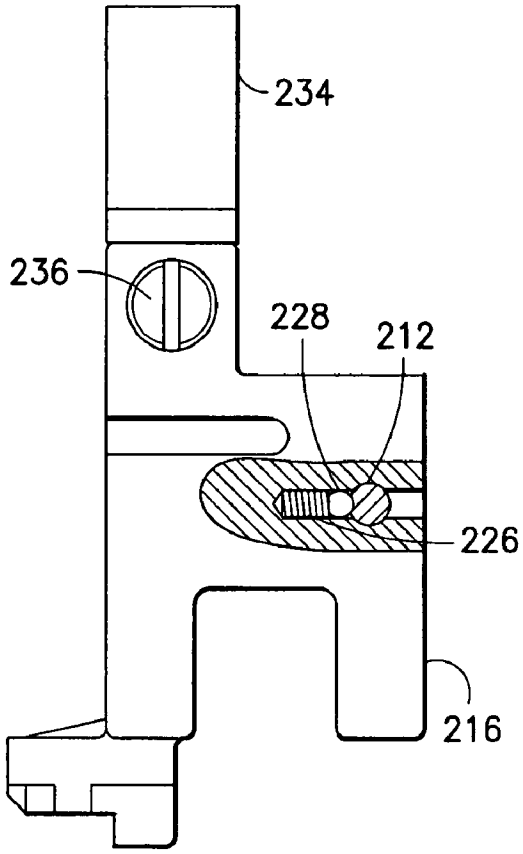
FIG. 16B is a side view, partially in section of the alternate embodiment sight with the cylinder removed.
Figure 16A:
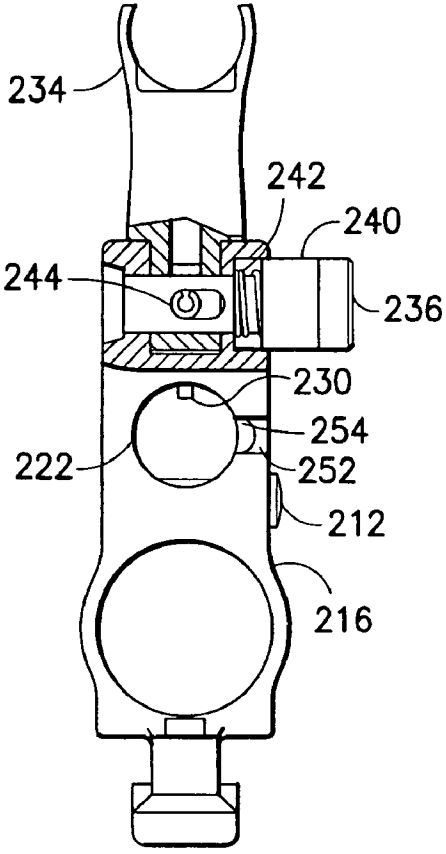
FIG. 16A is a front view, partially in section of the alternate embodiment sight with the cylinder removed.

Referring now to FIG. 14A, there is shown an end view of alternate embodiment sight 210. Referring also to FIG. 14B, there is shown a side view of alternate embodiment sight 210. Referring also to FIG. 14C, there is shown an isometric view of alternate embodiment sight 210. Referring also to FIG. 14D, there is shown an isometric view of alternate embodiment sight 210 with cylinder 214 removed. Referring also to FIG. 16A, there is shown a front view, partially in section of alternate embodiment sight 210 with cylinder 214 removed. Referring also to FIG. 16B, there is shown a side view, partially in section of alternate embodiment sight 210 with cylinder 214 removed. Referring also to FIG. 16C, there is shown a rear view, partially in section of alternate embodiment sight 210 with cylinder 214 removed. Front sight assembly 210 generally comprises gas block 216, sight portion 234 and a spring loaded pivot or detent assembly 236. Assembly 236 has post 240 and spring 242 biasing the post 240 in a locked position. Post 240 has a tapered rectangular feature that positively seats in a mating rectangular recess 246 of block 216 (see FIG. 17A). Post 240 also has a slot that cooperates with pin 244 of sight 234 such that as post 240 is rotated, sight 234 is also rotated. To lower sight 234, post 240 is pressed in against spring 242 and disengaging rectangular feature 246 allowing sight 234 to be rotated to a lowered position. As noted before, in alternate embodiments, the firearm may be provided with a one piece upper receiver with integral hand guard, and with an indirect gas operating system facilitating automatic or semi-automatic operation. Such a receiver, hand guard and operating system is disclosed in U.S. patent application Ser. No. 11/154,738 filed Jun. 16, 2005 and U.S. patent application Ser. No. 11/352,036 filed Feb. 9, 2006; both of which were previously incorporated by reference herein in their entirety. In the exemplary embodiment shown in FIGS. 14A-14C a gas block 216, may have a removable cylinder 214 therein. The gas block 216 is fitted to barrel assembly 14 where barrel assembly 14 has a bore with the cylinder being in fluid communication with the bore through a port. A piston and rod assembly 50 (see FIG. 2) having a piston and an operating rod 500 may be housed within the hand guard of the upper receiver (in a manner similar to that shown in FIG. 4). The piston is fitted to removable cylinder 214. The barrel has a bore 14BB for exhausting firing gases. The cylinder 214 in the gas block has a port in fluid communication with the bore through a port 216P (See FIG. 17D) disposed on a surface of the gas block 216 facing the barrel. The piston and rod assembly 50P housed within hand guard and receiver when mounted to the firearm cooperate with the gas block 216 and cylinder 214 where piston 50 is movably fitted to the cylinder 214. In alternate embodiments, other suitable assemblies may be used, for example, where the piston and rod are of two piece or unitary construction. Gas block 216 has a bore 222 that houses cylinder 214. In alternate embodiments, the indirect gas operating system may have valving or pressure regulator to allow the user to select a desired operating pressure, for example, to change the firing rate. Examples of such regulators are disclosed in U.S. Patent Application 60/610,703 filed Sep. 17, 2004 and Ser. No. 11/231,063 filed Sep. 19, 2005, both of which were previously incorporated by reference herein in their entirety. In the embodiment shown, the indirect gas operating system incorporates a quick removable gas piston cylinder 214, where the cylinder sleeve 214 may be removable from the front of gas block 216 and therefore removable from the front of the receiver or rail. Upon removal of sleeve 214, the piston and operating rod may similarly be removed from the firearm without further disassembly, for example to allow for cleaning and maintenance without further disassembly. Removable gas piston cylinder sleeve 214 is maintained captive with takedown pin 212 below piston cylinder sleeve 214 engaging slot 224 (see FIG. 20B). The take down pin is held captive, for example, by the spring 226 and detent ball 228. Indexing pin 230 is provided for aligning purposes, aligning piston cylinder sleeve 214 in proper angular orientation relative to gas block 216. Gas ports 232 may be provided in the cylinder and/or the gas block 216, for example the gas ports may be both gas intake port(s) and exhaust port(s).

Figure 15:
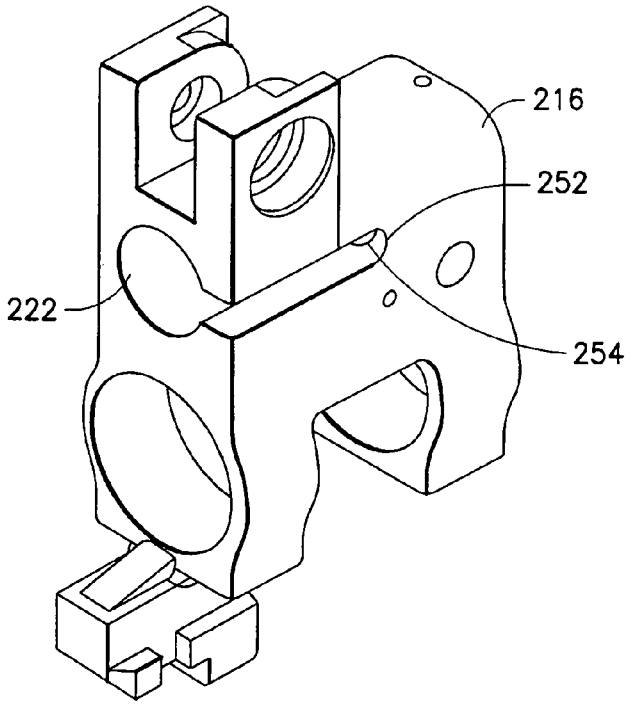
FIG. 15 is an isometric view of a gas block in accordance with an exemplary embodiment.
Figure 17A:
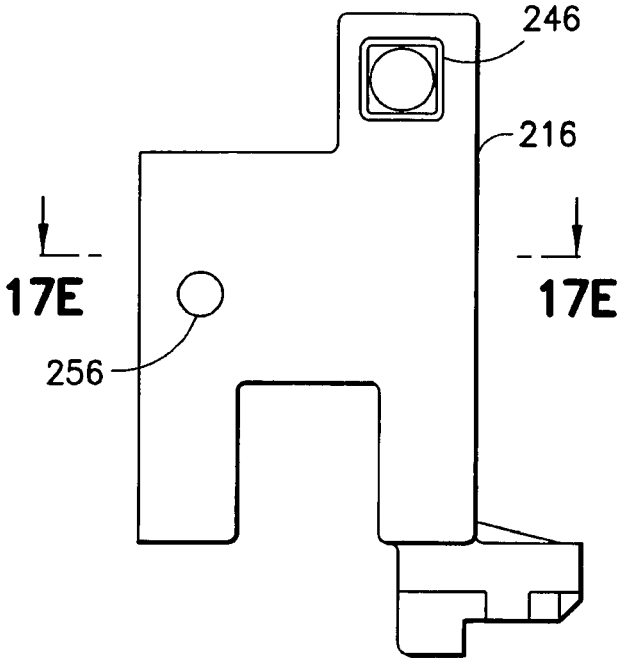
FIG. 17A is a side view of a gas block in accordance with another exemplary embodiment.
Figure 17B:
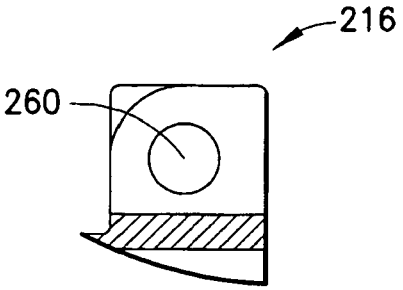
FIG. 17B is a partial section view of the gas block.
Figure 17C:
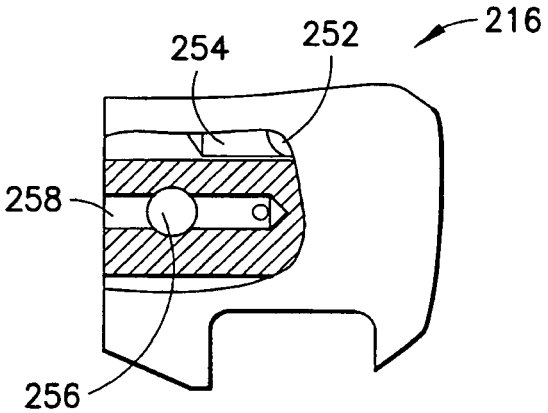
FIG. 17C is a partial section view of the gas block.
Figure 17D:
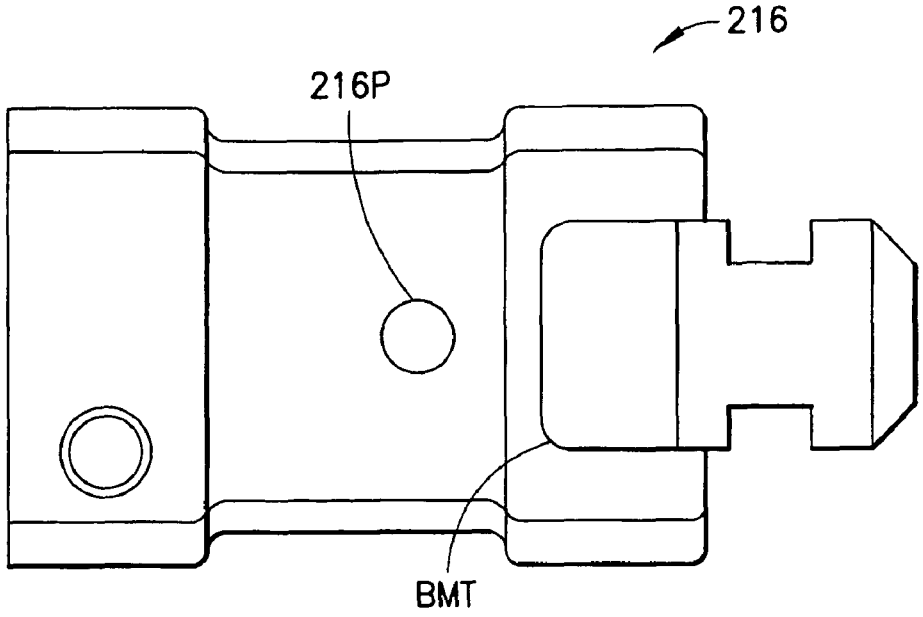
FIG. 17D is a partial view of the gas block.
Figure 17E:
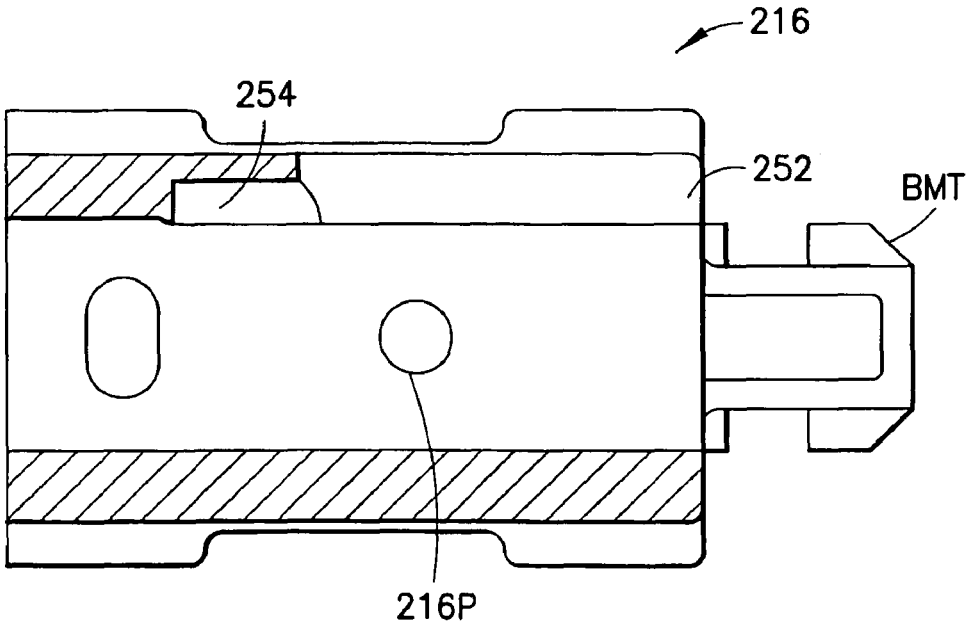
FIG. 17E is a partial section view of the gas block.

Referring now to FIG. 15, there is shown an isometric view of gas block 216. Referring also to FIG. 17A, there is shown a side view of gas block 216. Referring also to FIG. 17B, there is shown a partial section view of gas block 216. Referring also to FIG. 17C, there is shown a partial section view of gas block 216. Referring also to FIG. 17D, there is shown a partial view of gas block 216. Referring also to FIG. 17E, there is shown a partial section view of gas block 216. Bore 222 is provided for the mounting of cylinder 214. Port 216P communicates with port 14*b* of barrel 14 and port 250 of cylinder 214. In the exemplary embodiment, exhaust slot 252 and exhaust backcut 254 may be provided to communicate with exhaust port 232 (see FIG. 19) of cylinder 214 such that as piston 50 passes port 232, exhaust gasses are vented through port 232 via cut and port 254 and lateral exterior slot 252 towards the front of the rifle but offset from the centerline of piston 50 minimizing interference with sighting due to exhausted firing gases at the gas block. Bore 256 is provided to locate takedown pin 212 with bore 258 provided for retaining spring and ball 226, 228. Backcut 260 is provided to allow sight 234 to clear gas block 216 during lowering or raising.

Figure 18:
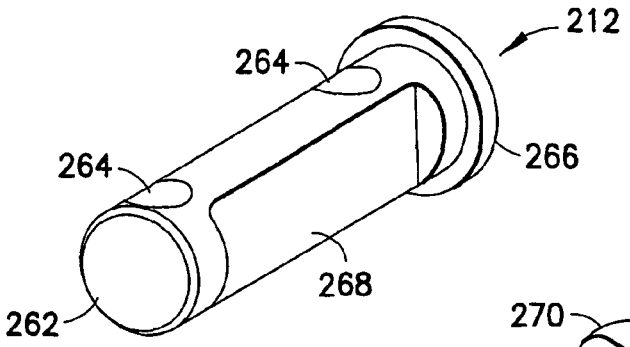
FIG. 18 is an isometric view of a take down pin.

Referring now to FIG. 18, there is shown an isometric view of take down pin 212. Take down pin 212 has shaft 262 that interfaces with bore 256 of block 216 and back cut 224 of cylinder 214, retaining cylinder 214 when engaged. Shoulder 266 prevents pin 212 from being pushed through block 216 while locating cuts 264 relative to ball detent 228 for retention in block 216. Flat 268 is also provided.

Figure 19:
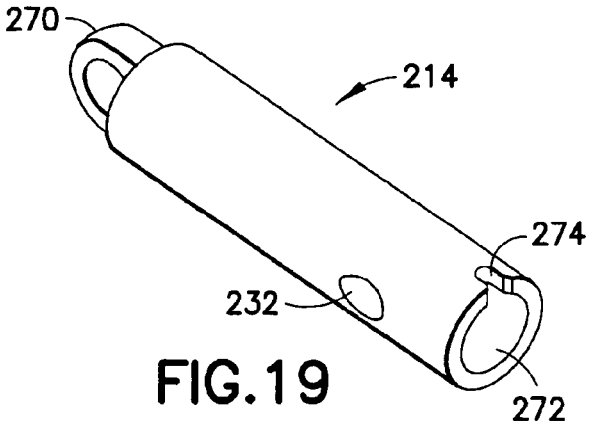
FIG. 19 is an isometric view of a gas cylinder.
Figure 20A:
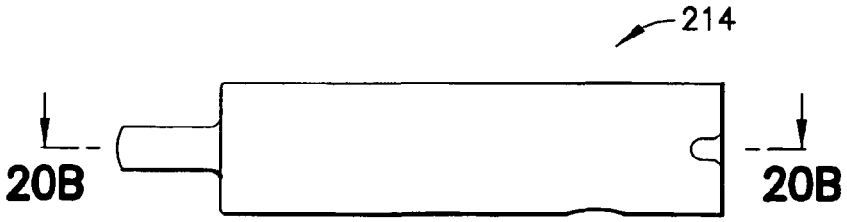
FIG. 20A is a top view of the gas cylinder.
Figure 20B:
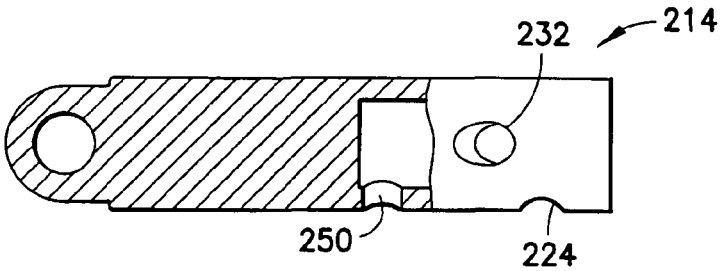
FIG. 20B is a section view of the gas cylinder.

Referring now to FIG. 19, there is shown an isometric view of cylinder 214. Referring also to FIG. 20A, there is shown an top view of cylinder 214. Referring also to FIG. 20B, there is shown a section view of cylinder 214. Cylinder 214 has lug 270, bore 272 and alignment slot 274. Lug 270 allows the cylinder 214 to be removed from bore 222 with tools if necessary, for example when fouled excessively. Bore 272 interfaces with piston 50P and is sufficiently deep to allow piston 50P to properly seat therein. Alignment slot 274 interfaces with pin 230 in order to prevent incorrect orientation of cylinder 214 within gas block 216. Supply port 250 communicates with the barrel 14 via port 216P in block 216. Exhaust port 232 formed in the sidewall of the cylinder may be angled outward and toward the front or muzzle of the firearm to direct exhaust gasses there through to back cut 254 and slot 252 of block 216. The combination of angled port 232, back cut 254 and slot 252 provide forward facing exhaust whereby exhaust gas is exhausted gas away from the operator hands.

It should be understood that the foregoing description is only illustrative of the invention. Various alternatives and modifications can be devised by those skilled in the art without departing from the invention. Accordingly, the present invention is intended to embrace all such alternatives, modifications and variances.

Embodiments of the invention has been described above, but it will be apparent to a reader skilled in the art that alterations, modifications and variations can be effected to the particular embodiments without departing from the scope of the invention, which is defined solely by the claims appended hereto. For example, it will be understood by persons of ordinary skill in the art that the dimensions may be appropriately scaled for firearms of different calibers.

What is claimed is:

1. A semi-automatic or automatic rifle, comprising:

an upper hand guard and a lower hand guard each removably secured to an upper receiver of the rifle, wherein the upper hand guard has an integral upper rail that extends along an upper surface of the upper hand guard and the upper hand guard has a rear tab that is received within a mating slot of the upper receiver when the upper hand guard is secured to the upper receiver and wherein the upper rail of the upper hand guard is contiguous with a receiver rail when the upper hand guard is secured to the upper receiver;

a cap configured to releasably engage a forward end of the upper hand guard and a forward end of the lower hand guard; and wherein the upper hand guard and the lower hand guard are not directly secured to a barrel of the rifle such that the upper hand guard and the lower hand guard float in position relative to the barrel of the rifle.

2. The rifle as in claim 1, wherein cap is secured to the forward end of the upper hand guard and the forward end of the lower hand guard with a plurality of pins.

3. The rifle as in claim 2, wherein the upper hand guard and the lower hand guard are releaseably secured to the upper receiver by a collar.

4. The rifle as in claim 1, wherein the upper hand guard and the lower hand guard are releaseably secured to the upper receiver by a collar.

5. The rifle as in claim 1, wherein the rifle further comprises: an indirect gas operating system having a gas block and a movable piston located outside of the upper receiver, the gas block being coupled to the barrel of the rifle and in fluid communication with the barrel, the movable piston in communication with the gas block.

6. The rifle as in claim 5, wherein the piston is removable from a front of the gas block of the rifle without disassembly of the gas block from the rifle and wherein the gas block has a foldable sight mounted thereon.

7. The rifle as in claim 1, wherein the lower hand guard has a six o'clock rail with respect to the barrel of the rifle and wherein the upper rail of the upper hand guard is a twelve o'clock rail with respect to the barrel of the rifle.

8. The rifle as in claim 1, wherein the upper rail of the upper hand guard extends completely along the rear tab of the upper hand guard.

9. A method for removably securing a hand guard to a semi-automatic or automatic rifle, the method comprising:

removably coupling a rear end of an upper hand guard to an upper receiver of the rifle;

removably coupling a rear end of a lower hand guard to an upper receiver of the rifle;

removably coupling a forward end of the upper hand guard and a forward end of a lower hand guard to a cap, wherein the upper hand guard and the lower hand guard are not directly secured to a barrel of the rifle such that the upper hand guard and the lower hand guard float in position relative to the barrel of the rifle and wherein the upper hand guard has an integral upper rail that extends along an upper surface of the upper hand guard and the upper hand guard has a rear tab that is received within a mating slot of the upper receiver when the upper hand guard is secured to the upper receiver and wherein the upper rail of the upper hand guard is contiguous with a receiver rail when the upper hand guard is secured to the upper receiver.

10. The method as in claim 9, wherein cap is secured to the forward end of the upper hand guard and the forward end of the lower hand guard with a plurality of pins.

11. The method as in claim 10, wherein the upper hand guard and the lower hand guard are releaseably secured to the upper receiver by a collar.

12. The method as in claim 9, wherein the upper hand guard and the lower hand guard are releaseably secured to the upper receiver by a collar.

13. The method as in claim 9, wherein the rifle further comprises: an indirect gas operating system having a gas block and a movable piston located outside of the upper receiver, the gas block being coupled to the barrel of the rifle and in fluid communication with the barrel, the movable piston in communication with the gas block.

14. The method as in claim 13, wherein the piston is removable from a front of the gas block of the rifle without disassembly of the gas block from the rifle and wherein the gas block has a foldable sight mounted thereon.

15. The method as in claim 9, wherein the lower hand guard has a six o'clock rail with respect to the barrel of the rifle and wherein the upper rail of the upper hand guard is a twelve o'clock rail with respect to the barrel of the rifle.

16. The method as in claim 9, wherein the upper rail of the upper hand guard extends completely along the rear tab of the upper hand guard.

17. The method as in claim 16, wherein the lower hand guard has a six o'clock rail with respect to the barrel of the rifle and wherein the upper rail of the upper hand guard is a twelve o'clock rail with respect to the barrel of the rifle.

* * * * *